US006571589B1

(12) United States Patent
Ito et al.

(10) Patent No.: US 6,571,589 B1
(45) Date of Patent: Jun. 3, 2003

(54) BENDING MACHINE AND ITS OPERATION METHOD

(75) Inventors: Shunitsu Ito, Ichinomiya (JP); Atsutoshi Goto, Fuchu (JP)

(73) Assignees: Murata Kikai Kabushiki Kaisha, Kyoto (JP); Amiteq Co., Ltd., Tokyo (JP)

( * ) Notice: Subject to any disclaimer, the term of this patent is extended or adjusted under 35 U.S.C. 154(b) by 293 days.

(21) Appl. No.: 09/680,298

(22) Filed: Oct. 6, 2000

(30) Foreign Application Priority Data

Oct. 7, 1999 (JP) ..... 11-286744

(51) Int. Cl.[7] ..... B21D 5/02

(52) U.S. Cl. ..... 72/31.11; 72/31.1; 72/389.3; 72/389.6; 72/319

(58) Field of Search ..... 72/31.1, 31.11, 72/389.3, 389.6

(56) References Cited

U.S. PATENT DOCUMENTS 4,489,586 A * 12/1984 Hess ..... 72/31.11
4,640,113 A * 2/1987 Dieperink et al. ..... 72/702
4,802,357 A * 2/1989 Jones ..... 72/389.3
5,584,199 A * 12/1996 Sartorio ..... 72/18.1
5,603,236 A * 2/1997 Hongo ..... 72/31.11
5,842,336 A * 12/1998 Klingel et al. ..... 72/31.11

FOREIGN PATENT DOCUMENTS

JP 02-630720 4/1997
JP 10-153203 6/1998
SU 825237 * 4/1981 ..... 72/389.4

* cited by examiner

*Primary Examiner*—David Jones
(74) *Attorney, Agent, or Firm*—Armstrong, Westerman & Hattori, LLP

(57) ABSTRACT

The present invention provides a bending machine that enables an angle measuring instrument to be compactly built into a mold for accurate processing. The present invention also provides an operation method besed on learning control which achieves accurate bending with this bending machine taking spring back into consideration. A bending machine carries out bending using lineraly extending an upper die 4 and a lower die 2, the upper die 4 having a built-in angle measuring instrument 9. The angle measuring instrument 9 is composed of a corner contacting member 12 with links and an inductive linear position detector 13 for measuring displacement of the corner contacting member 12. In operation for learning, the position of and a load on the upper die 4 and a bend angle are measured during a bending process and a bend angle after spring back is subsequently measured. Based on the interrelationship between the measured values, a next correction value is obtained for an adjustable position of the bending machine which controls the bend angle.

9 Claims, 21 Drawing Sheets

- RS1 TO RS4 : EXAMPLES OF RAM CYLINDER SPEED COMMANDS
- Q1 : EXAMPLE OF DETECTED ANGLE UPON PRESSURIZATION
- Q2 : EXAMPLE OF DETECTED ANGLE AFTER SPRING BACK
- QM : TARGET ANGLE

BENDING MACHINE AND ITS OPERATION METHOD

FIELD OF THE INVENTION

The present invention relates to a bending machine such as a press brake and its operation method, and in particular, to a bending machine that can detect an angle during bending.

BACKGROUND OF THE INVENTION

Conventional bending machines such as press brakes measure a bend angle in line to control it during processing or determine whether or not the bend angle of processed work is appropriate. In these bending machines, an angle measuring instrument for measuring the bend angle in line is generally installed near an upper die and installed in and removed from a bent portion of the work using a measuring instrument inserting and removing mechanism. Some angle measuring instruments have been proposed which have an angle measuring instrument integrated into the upper die.

Some bending machines using the above described measuring instrument inserting and removing mechanism insert a corner contacting member shaped like a parallel link into the bent portion of a work such as a metal sheet and detect a bend angle by using a rotary encoder to measure displacement of a linear position of a linkage section occurring when the corner contacting member comes in contact with a corner forming surface of the work (Japanese Patent Publication Number 2630720). According to this patent, the measurement can be made substantially irrespective of the position of the work and regardless of the effect of variations in the thickness of the work or dimensions of opposite surface of a recessed corner of the work.

Since, however, the displacement of the linear position of the corner contacting member is converted into rotation of the encoder, a possible minor error in a motion converting section of the encoder limits measuring accuracy. Accordingly, it is difficult to further improve measuring accuracy. In addition, the needs for the measuring instrument inserting and removing mechanism in turn require the size of the entire measuring apparatus to be increased, so that it is difficult to install a plurality of angle measuring instruments in order to measure the angle at a plurality of locations spaced in a bending line direction of the work. Such measurements at a plurality of locations are desirable for obtaining through accuracy for bending.

Integrating the above described angle measuring instrument into the upper die facilities installation of angle measuring instruments at a plurality of locations, but due to its three-dimensional shape having certain length, breadth and depth dimensions, the rotary encoder cannot be integrated into a flat part such as the upper die of the press brake. The upper die of the press brake has a thickness of, for example, several millimeters and few angle measuring instruments that can be integrated into such a flat press die without affecting its strength have been used for practical applications.

Examples of proposed angle measuring instruments integrated into the upper die of the press brake insert two scanning elements of different widths into a recessed corner of work to bring opposite ends of each of the elements into contact with corresponding surfaces of the recessed corner and convert a difference in recessed corner advancing depth between the scanning elements, into a bend angle. Each of the scanning elements is shaped like a disc or a rod. The difference in advancing depth is detected by an optical sensor such as a PSD (Position Sensing Detector).

The optical sensor, however, is easily affected by heat and has its measuring accuracy reduced by heat generated during bending. In addition, since the upper die must have a split structure only to integrate the angle measuring instrument thereinto, the upper die has a complicated structure and has its strength reduced, thereby requiring the size of the upper die to be increased to compensate for the complicated structure and the reduced strength.

In addition, the bending of work involves a phenomenon called "spring back" where the bend angle is diminished, though slightly, due to the elasticity of the work, thereby precluding accurate detections or requiring a long period of time for detections. For example, to detect the bend angle after spring back, a bending load must be released. In this case, the position of the work may change and such a change in position must be flexibly dealt with. Consequently, the bending machine with an angle measuring instrument integrated thereinto must be improved and a method for effectively operating such a bending machine must be developed.

Other angle measuring instruments installed in the bending machine are applications of image processing, and irradiate a measured target with a slit light from a semiconductor laser and use a CCD camera to pick up an image of a bent portion to determine its bend angle. These measuring instruments, however, have their measuring accuracy significantly affected by variations in ambient brightness and require a complicated and expensive structure.

It is an object of the present invention to provide a bending machine that can build an angle measuring instrument into a mold to accurately measure an angle during bending.

It is another object of the present invention to enable the angle to be accurately measured without attenuating signals attenuation while eliminating the effects of variations in temperature using a simple structure.

It is yet another object of the present invention to allow an angle measuring instrument to be easily built into a mold by splitting the mold.

It is still another object of the present invention to provide a method for operating a bending machine wherein an angle measuring instrument built into an upper die is used to achieve accurate bending taking spring back into consideration.

SUMMARY OF THE INVENTION

The present invention provides a bending machine for carrying out bending by using a linearly extending male and female dies to sandwich a work therebetween, the bending machine being characterized in that the male die has an angle measuring instrument integrated thereinto for measuring a bend angle of the work bent by the male and female dies and the angle measuring instrument has an inductive linear position detector.

With this configuration, the angle measuring instrument is integrated into the male die to enable angle detections during bending. In addition, the angle measuring instrument advances into a bent portion of the work as the male die is elevated or lowered for bending or the like, thereby eliminating the needs for a mechanism exclusively used to drive the angle measuring instrument forward and backward. The angle measuring instrument has the inductive linear position detector, small accurate inductive linear position detectors have been used for practical applications and enable accurate angle detections when used in the angle measuring instrument. Such a linear position detector can also be easily integrated into a male die comprising a flat press die as in a press brake. Various inductive linear position detectors are available including differential transformers and phase shift detectors.

Specifically, the angle measuring instrument comprises a corner contacting member that comes in contact with opposite sides of a recessed corner resulting from the bending of the work to have its linear position displaced depending on an opening angle between corner forming surfaces and an inductive linear position detector for measuring displacement of the linear position of the corner contacting member.

The linear position detector preferably detects a change in linear position based on a change in phase angle and has a function for using an output from a plurality of coils or impedance means to compensate for a temperature characteristics of a coil for detecting the linear position.

When the position detection is based on a change in phase angle, the position can be accurately detected without being affected by signal attenuation. In addition when the linear position detector has a function for using an output from a plurality of coils or impedance means to compensate for a temperature characteristic of a coil for detecting the linear position, the position can be easily detected while eliminating the effects of variations in temperature. Thus, measurements can be made without being affected by heat generated during bending, thereby eliminating the needs for a correction corresponding to an operation time or the like.

Specifically, the linear position detector can be configured to have, for example, a plurality of coils excited by an in-phase alternating current (AC) signal, a magnetic responding member having its linear position displaced to change inductance of the coils, and an operation circuit. In this case, the operation circuit combines output voltages from the plurality of coils to generate a plurality of AC output signals to detect a phase angle corresponding to the displacement of the linear position based on the correlationship between amplitude values of the plurality of AC output signals.

The male die may be formed of a plurality of split dies arranged in a die width direction so that the die width can be changed by changing the number of arranged split dies. In this case, any ones of the split dies have an housing recess in side end surfaces thereof in which the angle measuring instrument is housed. If the recess is formed in the split surface of the split dies arranged in the die width direction and the angle measuring instrument is housed in this recess, then the splitting for changing the die width can be used to facilitate the integration of the angle measuring instrument into the die. Additionally, the recess for housing the angle measuring instrument is located in the side end surfaces of the split dies, so that angle measuring instruments can be installed at a plurality of locations in the die width direction of the upper die to detect the bend angle at the plurality of locations along a trace of a bent portion in order to easily obtain through accuracy for bending. The split dies with the angle measuring instrument interposed therebetween are adapted to be simultaneously changed between an arranged state and a non-selected state with respect to an operative position.

The present invention provides a method for operating a bending machine having one of the above described configurations of the present invention, the method being characterized by comprising measuring, during a bending process, an elevated and lowered positions of an upper die corresponding to the male die, a load acting on the upper die, and the bend angle of the work, measuring, after the bending process, the bend angle of the work after spring back after returning the upper die to some degree or releasing pressurization on the upper die, and obtaining a next correction value for an adjustable portion for controlling the bend angle for the bending machine, based on an interrelationship among the measured elevated and lowered positions of the upper die, the measured load acting on the upper die, the measured bend angle of the work, and the measured bend angle after spring back. The elevated and lowered positions of the upper die can be indirectly indicated in terms of time because they can be determined in terms of time if a speed curve for an elevating and lowering operations has previously been determined. The elevated and lowered positions of the upper die can be indicated in terms of time for an operation method according to another aspect of the present invention.

In the bending of work, predetermined relations occurs between the elevated and lowered positions of the upper die and the load acting on the upper die and the bend angle of the work, and affects the amount of spring back. Thus, by measuring the elevated and lowered positions of the upper die, the load acting on the upper die, and the bend angle of the work during bending and then measuring the bend angle after spring back to obtain the next correction value for the adjustable portion of the bending machine, which affects the bend angle, the next bending can be executed accurately. By measuring, after the bending, the bend angle after spring back after returning the upper die to some degree or releasing pressurization on the upper die, the angle present after spring back has occurred actually can be easily and accurately measured using the angle measuring instrument integrated into the upper die. This method for operating the bending machine may be used only during trial bending and the bending machine may subsequently be corrected using a next correction value obtained during the trial bending.

This method for operating a bending machine may comprise preparing a pattern table indicating a plurality of patterns into which the interrelationship between the elevated and lowered positions of the upper die and the load acting on the upper die and the bend angle of the work which are measured during the bending process has been classified, and correction value conversion data for each of the patterns which provide the next correction value for the adjustable portion corresponding to the bend angle after spring back, comparing the pattern table with the elevated and lowered positions of the upper die and the load acting on the upper die and the bend angle of the work which have been measured during the bending process, to select a corresponding pattern, and using the correction conversion data for the selected pattern to convert the bend angle after spring back measured after the bending process in order to obtain the next correction value for the adjustable portion.

Results of the inventors' studies indicate that the relationship curve between the bending angle after spring back and the amount that the adjustable portion is adjusted to control the bending angle can be classified into a plurality of patterns based on the interrelationship between the elevated and lowered positions of the upper die and the load acting on the upper die and the bend angle of the work which occur during the bending process, and also indicate that the patterns have a common tendency. For example, patterning is possible based only on the relations between the above measured values despite a change in the thickness of the work or the material thereof. Accordingly, by preparing the pattern table and the correction value conversion data for each pattern, selecting a pattern based on the measured values obtained during the bending process, and obtaining the next correction value for the adjustable portion through a conversion using the correction value conversion data for the selected pattern, bending is easily and promptly achieved without the needs for complicated arithmetic operations. To obtain the next correction value using the correction value conversion data depending on the bending angle after spring back, the bending angle may be directly used or an error between the bending angle after spring back and a target angle may be used.

In this method for operating a bending machine, if the bending machine is of such a type that a lower die corresponding to the male die has a variable bottom surface height such that bending is carried out by lowering the upper die until the work has been pressed against a bottom surface of the lower die, then the adjustable portion is located at the bottom surface height of the lower die. The next correction value obtained from the correction value conversion data is a correction value for the bottom surface height.

In this method for operating a bending machine, if the bending machine is of a type that determines the bend angle by adjusting an amount that the upper die corresponding to the male die advances into the lower die, then the next correction value obtained from the correction value conversion data is a correction value for a target value for overstroke in which the upper die is lowered further from the elevated or lowered position of the upper die which corresponds to a target angle for the work bend angle.

In the method for operating a bending machine wherein the lower die has a variable bottom surface height, the pattern of the relationship between the elevated and lowered positions of the upper die and the load acting on the upper die and the bend angle of the work which all occur during the bending process may be classified in such a manner as to correspond to a stroke of the upper die from a load dip point to a target angle and a stroke thereof from the target angle to the lowest point. Results of the inventors' studies indicate that more common patterning is achieved by classifying the pattern using strokes before and after the load dip point.

Another aspect of the invention provides a bending machine having one of the above described configurations of the present invention and having an adjustable portion for controlling the bend angle, the bending machine comprising the following learning control means.

The learning control means includes:

a pattern table indicating a plurality of patterns into which the interrelationship between an elevated and lowered positions of the upper die and a load acting on the upper die and the bend angle of the work which are measured during the bending process has been classified;

correction value conversion data for each of the patterns which provide the next correction value for the adjustable portion corresponding to the bend angle after spring back;

means for measuring the elevated and lowered positions of the upper die, the load acting on the upper die, and the bend angle of the work during the bending process;

means for measuring the bend angle of the work after the work has sprung back following returning of the upper die to some degree or releasing of pressurization on the upper die; and correction value generating means for selecting the corresponding pattern from the pattern table based values of the elevated and lowered positions of the upper die, the load acting on the upper die, the bend angle of the work which have all been obtained during the bending process, and using the selected pattern to generate the next correction value for the adjustable portion corresponding to the bend angle after spring back, in accordance with the correction value conversion data.

The learning control means configured as described above enables implementation of the operation method according to the present invention which obtains the above described patterned next correction value.

DETAILED DESCRIPTION OF THE PREFERRED EMBODIMENTS

Figure 1:
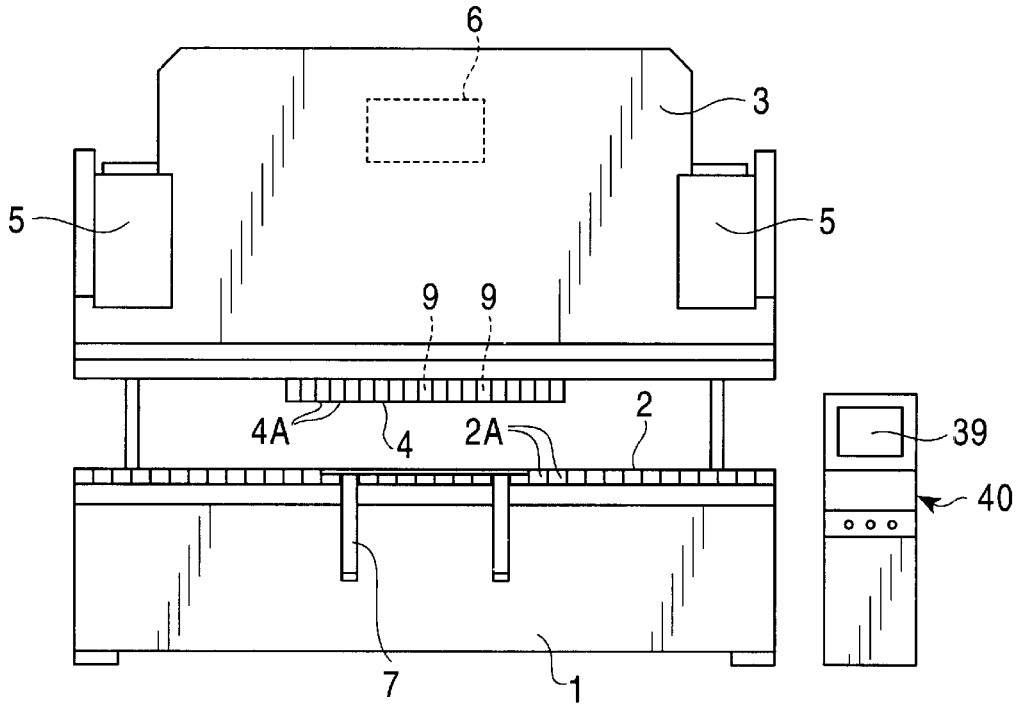
FIG. 1 is a front view of a bending machine according to one embodiment of the present invention.
Figure 2:
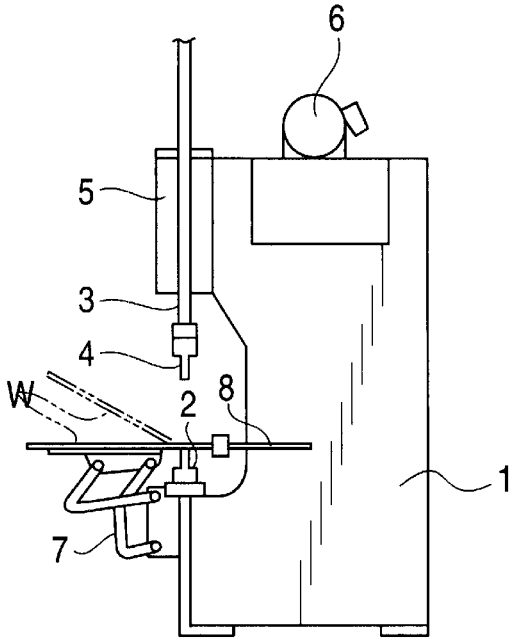
FIG. 2 is a side view of the bending machine.

One embodiment of the present invention will be described with reference to the drawings. FIG. 1 is a front view of a bending machine comprising an angle measuring instrument. FIG. 2 is a side view of the bending machine.

This bending machine is a press brake comprising a bed 1 having a linear lower die 2 mounted thereon and corresponding to a female die, and a ram 3 having an upper die 4 mounted on a lower end thereof and corresponding to a male die. The ram 3 is installed so as to be elevated and lowered at its opposite ends by means of guides 5 and is driven to elevate and lower by means of a ram elevating and lowering driving device 6. The ram elevating and lowering driving device 6 comprises an electric motor or a hydraulic cylinder and can control elevation or lowering to an arbitrary position.

The lower die 2 and the upper die 4 are split into a plurality of split dies 2A and 4A, respectively, in a die width direction. The die width can be changed by selecting the number of the arranged split dies 2A or 4A. The die width is changed by using a split die selecting mechanism (not shown in the drawings) to move the split dies 2A or 4A between operative positions used for processing (illustrated positions) and receded positions. One or all of the split dies 4A of the upper die 4 has/have an angle instrument measurement 9.

The bed 1 has a work support table 7 installed before the lower die 2 and a gauge 8 installed after the lower die 2. A work such as a metal sheet W to be bent is placed on the work support table 7 and inserted over the lower die 2 until it comes in abutment with the gauge 8. When the ram 3 lowers the upper die 4, the work W is sandwiched between the lower die 2 corresponding to the female die and the upper die 4 corresponding to the male die and then bent in a V form.

Figure 7:
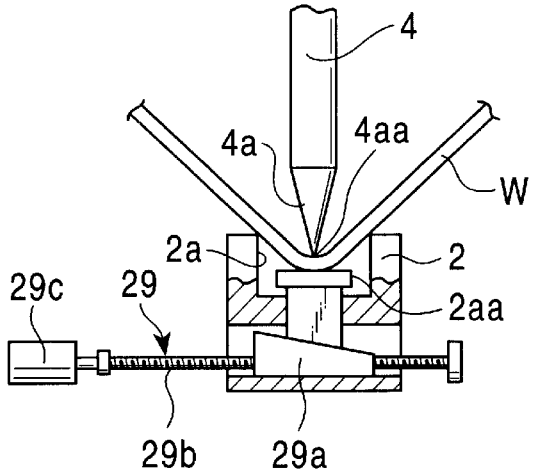
FIG. 7 is a side view showing the relationship between a lower die and the upper die of the bending machine.

According to this embodiment, the lower die 2 is for three-point bending and has a rectangular lower die groove 2*a* as shown in FIG. 7. The lower die 2 has a variable bottom portion 2*aa* having its vertical position adjusted to change the depth of the groove. The positional adjustment for the variable bottom portion 2*aa* is executed by a bottom surface height adjusting mechanism 29. The bottom surface height adjusting mechanism 29 is composed of a tapered member 29*a* that can advance and recede in contact with an inclined bottom surface of the variable bottom portion 2*aa*, a feed screw mechanism 29*b* for moving the tapered member 29*a* forward and backward, and a motor 29*c* for driving the feed screw mechanism 29*b*.

The upper die 4 comprises a tip portion 4*a* having an acute-angled V-shaped cross section with a tip edge 4*aa* having an obtuse-angled V-shaped or circularly curved cross section. The upper die 4 has a thickness sufficiently smaller than the width of the groove in the lower die 2.

With this lower die 2 for three-point bending, the work W is bent by lowering the upper die 4 until the work W reaches the bottom of the groove in the lower die 2. A bending angle for the work W is approximately determined based on the width and depth of the groove in the lower die 2 and perfectly determined also based on other factors including a bending load, that is, a pressurizing force that lowers the upper die 4 as well as the cross section of the circular or obtuse-angled tip edge 4*aa* of the upper die 4.

Figure 8:
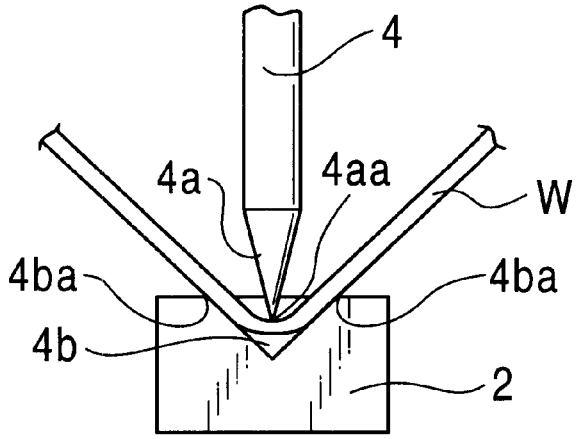
FIG. 8 is a side view showing the relationship between a variation of the lower die and the upper die of the bending machine.
Figure 9:
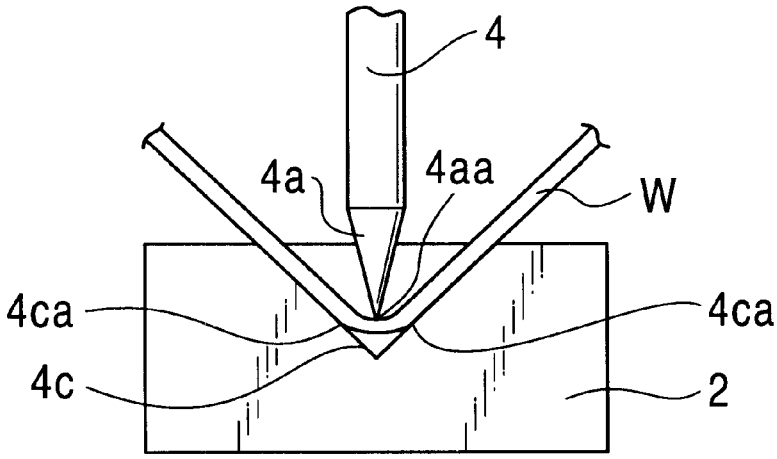
FIG. 9 is a side view showing the relationship between another variation of the lower die and the upper die of the bending machine.

Rather than for three-point bending as shown in FIG. 7, the lower die 2 may be for air bending as shown in FIG. 8 or for bottoming as shown in FIG. 9. With the air bending lower die 2 and the bottoming lower die 2, the lower die groove 2*b*, 2*c*, respectively, which constitute die surfaces are each V-shaped, but the air bending lower die 2 comes in contact with the work W at an opening edge 4*ba* of the lower die groove 2*b*, whereas the bottoming lower die 4 comes in contact with the work W in a groove bottom neighborhood portion 4*ca* of the lower die groove 2*b*.

For both the air bending and bottoming lower dies, the bend angle of the work W is determined by the groove width of the lower die groove 2*b*, the angle between the opposite sides of the groove, the cross section of the tip edge 4*aa* of the upper die 2, and the amount of advancement of the upper die 2 into the lower die.

Figure 3A:
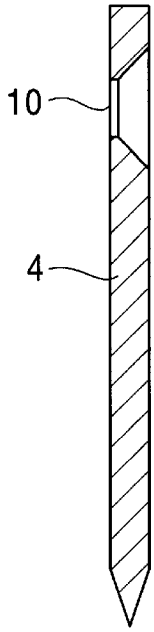
FIGS. 3A to 3C are a sectional, front, and side views, respectively, of a split die of an upper die of the bending machine.
Figure 3B:
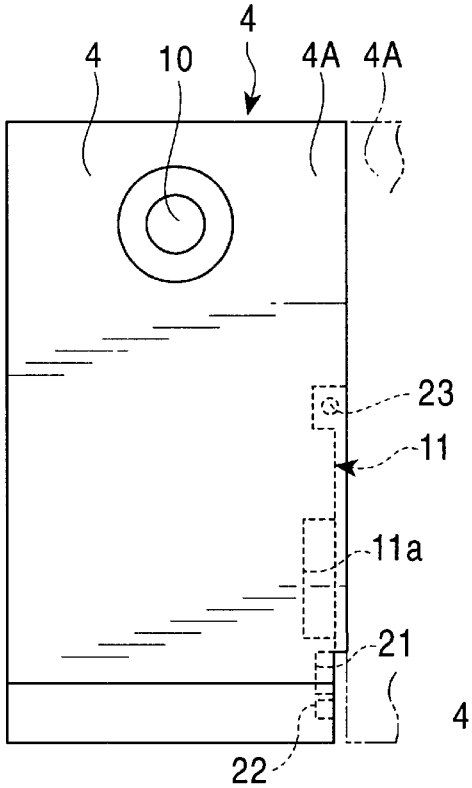
Figure 3C:
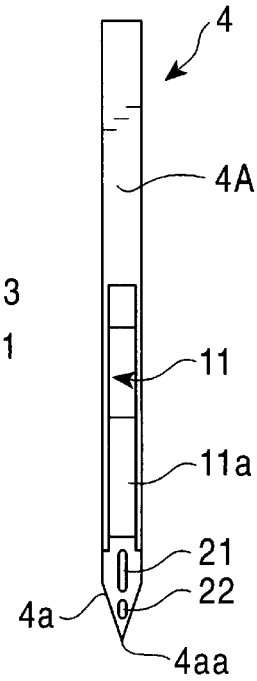
Figure 5A:
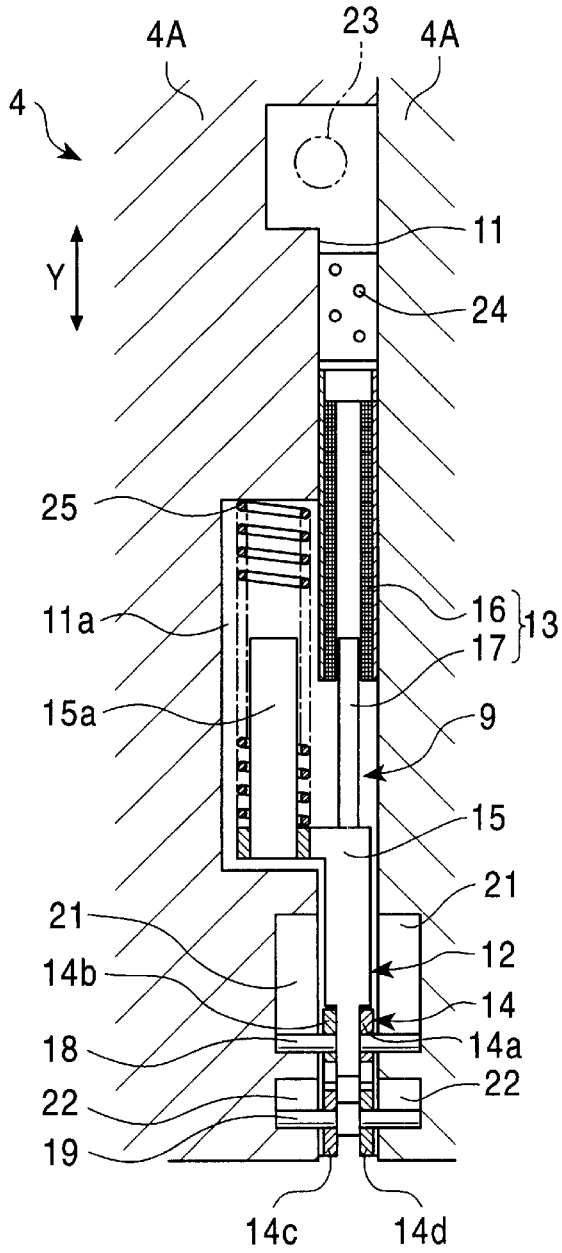
FIG. 5A is an exploded front view showing an angle measuring instrument built into the bending machine as well as the upper die.
Figure 5B:
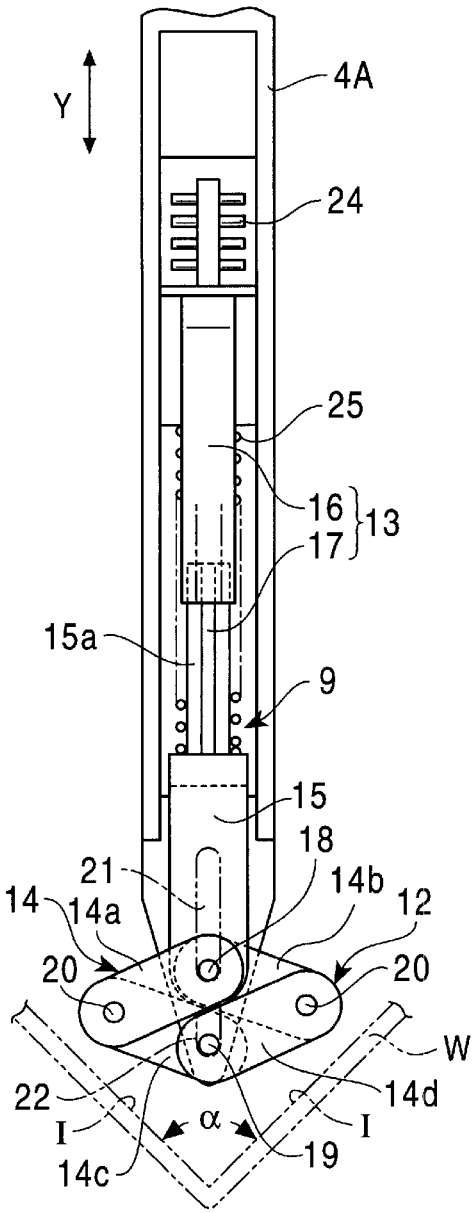
FIG. 5B is a side view thereof.

FIG. 3 shows one of the split dies 4A of the upper die 4. The split die 4A has an engagement section 10 in its upper part, the engagement section 10 being engaged with the above described split die selecting mechanism, and a housing recess 11 in its side end surface that is adjacent to a side end surface of another split die, the housing recess 11 housing an angle measuring instrument. The housing recess 11 is formed to be a groove extending in a vertical direction and has the angle measuring instrument 9 installed therein as shown in FIG. 5.

The angle measuring instrument 9 is composed of a corner contacting member 12 and an inductive linear position detector 13 which are housed in a lower and upper parts of the angle measuring instrument housing recess 11, respectively. The corner contacting member 12 comes in contact with opposite corner forming surfaces a and a forming a recessed corner obtained by bending the work W, a measured object, so that the linear position of the corner contacting member 12 is displaced in a Y-direction in a fashion corresponding to an opening angle $\alpha$ between the corner forming surfaces I, I. The linear position detector 13 measures the displacement of the linear position of the angle contacting member 12.

The angle contacting member 12 has a contact part 14 that advances into the recessed corner of the work W to come in contact with the opposite corner forming surfaces I, I and a linearly displaced part 15 that has its linear position changed in the advancement direction (vertical direction) Y into the recessed corner as the contact part 14 is displaced. The linear position detector 13 has a winding section 16 and a rod-shaped magnetic responding member 17 that can advance and recede inside the winding section 16 in a linear direction. The magnetic responding member 17 is fixed to the linearly displaced section 15 of the corner contacting section 12.

The contact part 14 is configured to be a parallel link mechanism comprising four links 14*a* to 14*d* sequentially connected together by means of two vertically spaced support pins 18, 19 and two laterally spaced connection pins 20, 20. The upper support pin 18 is provided in the linearly displaced part 15 and is movably guided by a guide 21 only in the vertical direction within a predetermined range (a range corresponding to the length of the guide).

The lower support pin 19 is spaced from the linearly displaced part 15 and is movably guided by a guide 22 only in the vertical direction within a predetermined idle range (a range corresponding to the length of the guide). The lower support pin 19 is at a reference position, while the upper support pin 18 is displaced. The lateral connection pins 20, 20 are arbitrarily moved. The guides 21, 22 are formed to be a pair of guide grooves formed in side end surfaces of the adjacent opposite split dies 4A, 4A, and the support pins 18, 19 project from opposite sides of the links 14*a* to 14*d* in such a manner that their projecting portions are movably fitted in the guides 21, 22, respectively.

Figure 4A:
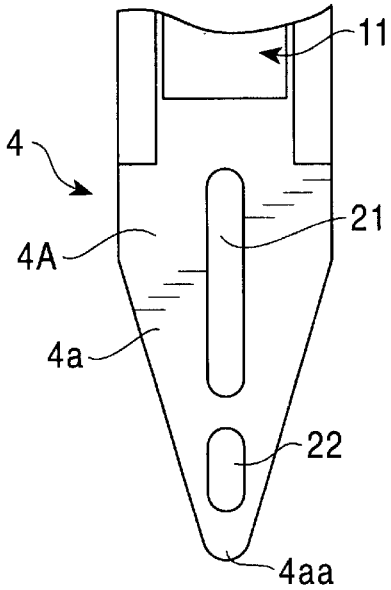
FIG. 4A is a side view showing a tip portion of the split die in an enlarged view.
Figure 4B:
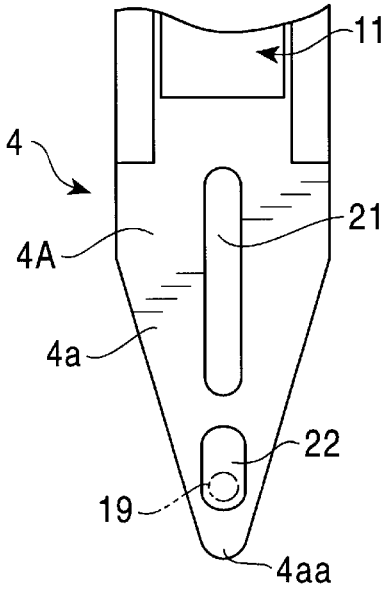
FIG. 4B is a sectional view of a variation thereof.

The guide 22 at the reference position is set so that its idle range is relatively small. The reference-side guide 22 may create a play within which the support pin 19 can move in a lateral direction, as shown by a variation in FIG. 4B.

In FIG. 5, the linearly displaced part 15 is installed in the split die 4A so as to move only in the vertical direction and is urged downward by a returning elastic body 25. The returning elastic body 25 comprises a compression coil spring provided around an outer periphery of a shaft section 15*a* projected from the linearly displaced part 15. Part of the returning elastic body 25 and the linearly displaced part 15 are housed in a deep groove section 11*a* formed in the angle measuring instrument housing recess 11.

The magnetic responding member 17 has its axis located to be orthogonal with the upper support pin 18 and the lower support pin 19 and is fixed to the linearly displaced part 15 in a fashion projecting upward therefrom. The winding section 16 has group of terminals 16*a* in an upper part thereof and led out through a wiring hole 23 formed in the split die 4A.

For the components of the angle measuring instrument 9, the split die 4A installs the winding section 16 of the linear position detector 13 therein and constitutes a contacting member guiding member for supporting the corner contacting member 12 so as to advance and receive freely.

The inductive linear position detector 13 is a device that uses the principle of electromagnetic inductance to detect the displacement of the linear position and includes a general differential transformer or a phase shift type linear position detector that outputs an alternating current (AC) signal having an electric phase angle correlated to the linear position of a detection target. In this example, the inductive linear position detector 13 is configured as described below.

Figure 10A:
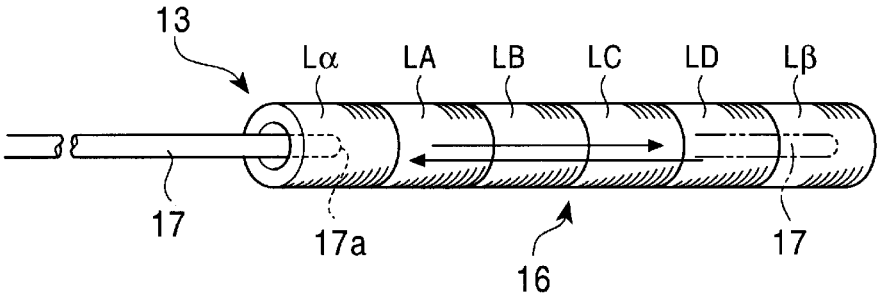
FIGS. 10A to 10C are an external perspective view showing a linear position detector of the angle measuring instrument, a sectional view along an axial direction of a coil, and an electric circuit diagram associated with the coil, respectively.
Figure 10B:
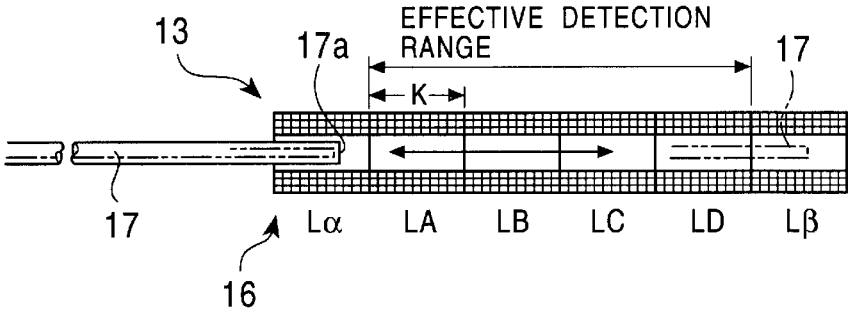
Figure 10C:
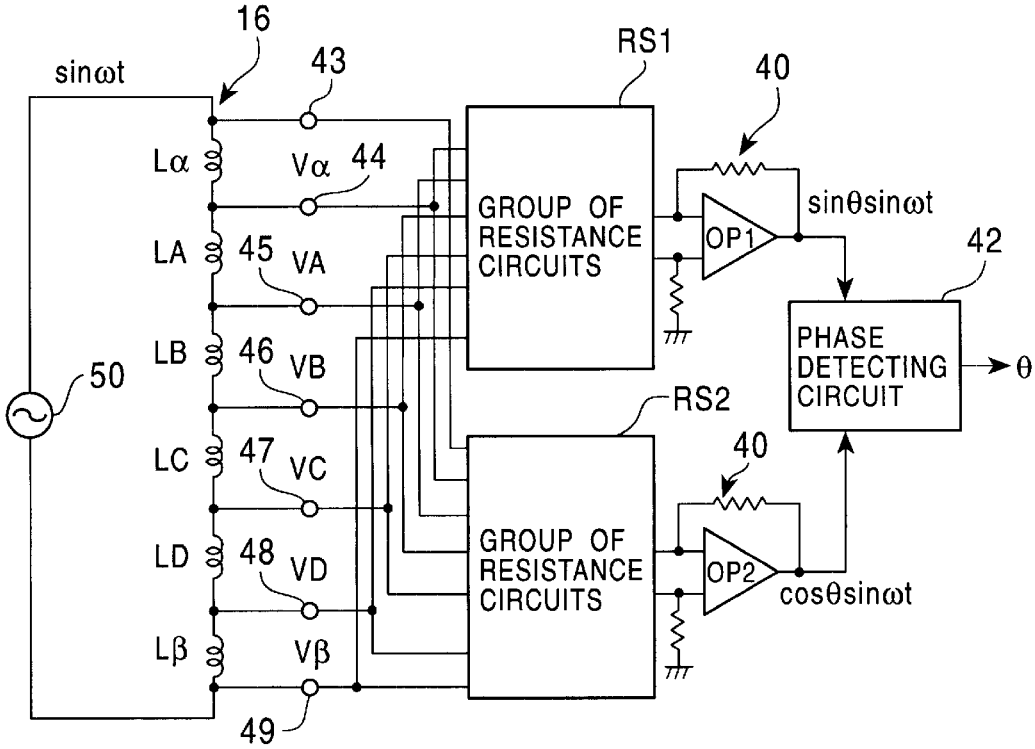

The linear position detector 13 has only a primary coil as shown in FIG. 10. In the example in FIG. 10, two AC outputs signals each having an amplitude showing a sine or cosine function characteristic have their amplitudes change within a full range of electric angle between 0 and 360 degrees. FIG. 10A is a schematic view of an example of a physical arrangement relationship between the winding section 16 and the magnetic responding member 17 of this linear position detector. FIG. 10B is a schematic sectional view seen in an axial direction of the coil. FIG. 10C shows an example of an electric circuit in the winding section 16. The linear position detector shown in FIG. 10 detects the linear position of the detection target and has the winding section 16 relatively fixed thereto and the magnetic responding member 17 relatively linearly displaced depending on the displacement of the detection target.

The magnetic responding member 17 is made of a material that magnetically changes characteristics of the coil, that is, a magnetic substance or a good conductor. The magnetic responding member 17 may partly comprise a magnetic substance or a good conductor, but in this example, it is entirely composed of such a material and formed to be, for example, an elongate pin like a wire.

The winding section 16 has a plurality of coils Lα, LA, LB, LC, LD, Lβ arranged along a direction in which the detection target in displaced, the coils being excited by an in-phase AC signal sinωt generated by an AC source 50. When the position of the magnetic responding member 17 relative to the winding section 16 changes, the inductance of each of the coils Lα, LA, LB, LC, LD, Lβ changes depending on this relative position, so that an end-to-end voltage of the coil increases or decreases gradually while an end 17*a* of the magnetic responding member 17 is displaced from one end to the other end of the coil.

In this example, the number of coils is six and an effective detection range corresponds to the four middle coils LA, LB, LC, LD. If the length of one coil is defined to be K, the effective detection range is 4K, which is as four times as long as the coil. The coils Lα, Lβ provided before and after the effective detection range, respectively, are supplementary. The supplementary coils Lα, Lβ serve to faithfully obtain a cosine function characteristicand may be omitted if accuracy is not strictly pursued. The coils Lα, LA, LB, LC, LD, Lβ need not be physically mutually separated but terminals may be provided in the middle of a continuous coil so that the each portion between the terminals acts as a separated coil.

Analog operation circuits 40, 41 include groups of resistance circuits RS1, RS2 and operational amplifiers OP1, OP2, respectively. End-to-end voltages Vα, VA, VB, VC, VD, Vβ are obtained from the coils Lα, LA, LB, LC, LD, Lβ via terminals 43, 44, 45, 46, 47, 48, 49, respectively, and an addition and/or a subtraction is executed on these voltages to generate a plurality of AC output signals sinθ sinωt and cosθ sinωt indicating amplitudes conforming to predetermined periodic-function characteristics depending on the position of the detection target (the position at which the end 71*a* of the magnetic responding member 17 advances into the winding section 16). By inputting these AC output signals sinθ sinωt and cosθ sinωt to a phase detecting circuit 42 to detect phase angle components θ of amplitude functions sinθ and cosθ, the detection target position can be absolutely detected. In the winding section 16, the number or arrangement of coils or the like is not limited to the illustrated example but may vary. Alternatively, outputs from the terminals 43 to 49 may be digitally processed.

Since the inductive linear position detector 13 in the illustrated example is small and can accurately detect angles, using it in the angle measuring instrument 9 enables the angle measuring instrument 9 to be compactly housed in the upper die 4 of the bending machine and also enables accurate bending with a simple configuration.

The operation of the linear position detector 13 will be specifically described.

Figure 11:
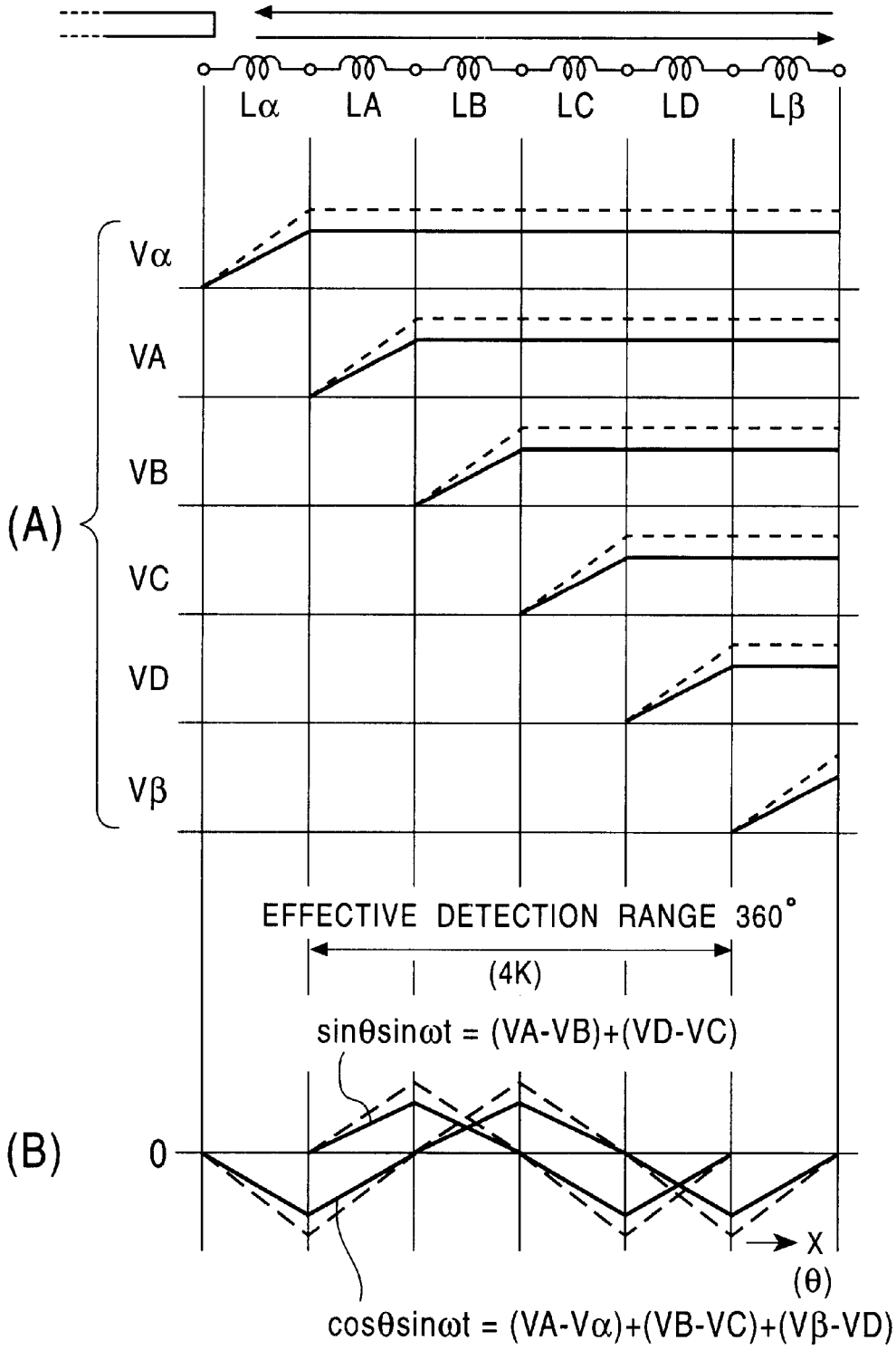
FIG. 11 is a graph useful in explaining a detection operation performed by the linear position detector.

As magnetic responding member 17 approaches or enters each coil, the self-inductance of each coil increases, so that the end-to-end voltage of the coil increases gradually while the end of this member is displaced from one end to the other end of the coil. Since the plurality of coils Lα, LA, LB, LC, LD, Lβ are sequentially arranged in the direction in which the detection target is displaced, the end-to-end voltage of each coil Vα, VA, VB, VC, VD, Vβ increases gradually and sequentially, as the position of the magnetic responding member relative to the coils is relatively displaced in response to the displacement of the detection target, as illustrated in FIG. 11A. In FIG. 11A, while a line indicating the output voltage from a certain coil is inclined, the magnetic responding member 17 is displaced from one end to the other end of this coil. Typically, a gradual increase curve for the end-to-end voltage of a certain coil which is observed while the end of the magnetic responding member 17 is displaced from one end to the other end of this coil can be assumed to indicate changes in the value of the sine or cosine function with 90 degrees. Thus, by appropriately combining the output voltages Vα, VA, VB, VC, VD, Vβ from each coil and executing an addition and/or a subtraction on the combined output voltages, the two AC output signals sinθ sinωt and cosθ sinωt can be generated which have the amplitudes indicating the sine and cosine function characteristics, respectively, depending on the detection target position.

That is, the analog operation circuit 40 can calculate the output voltages VA, VB, VC, VD from the coils LA, LB, LC, LD as shown in Equation (1) to obtain an AC output signal indicating an amplitude curve in turn indicating a sine function characteristic as shown in FIG. 11B. The signal can be equivalently denoted by "sinθ sinωt".

$$(VA-VB)+(VD-VC) \qquad \text{Equation (1)}$$

Alternatively, the analog operation circuit 41 can calculate the output voltages Vα, VA, VB, VC, VD, Vβ from the coils Lα, LA, LB, LC, LD, Lβ as shown in Equation (2) to obtain and AC output signal indicating an amplitude curve in turn indicating a cosine function characteristic as shown in FIG. 11B. The amplitude curve indicating the cosine function characteristic shown in FIG. 11B actually shows a minus cosine function characteristic, that is, "−cosθ sinωt" but corresponds to the cosine function characteristic because of its offset from the sine function characteristic by 90 degrees. Consequently, this is referred to as an AC output signal for the cosine function characteristic and is hereafter equivalently denoted by "cosθ sinωt".

$$(VA-V\alpha)+(VB-VC)+(VB-VD) \qquad \text{Equation (2)}$$

Equation (2') may be executed instead of Equation (2).

$$(VA-V\alpha)+(VB-VC)-VD \qquad \text{Equation (2')}$$

By electrically inverting the 180 degrees phase of the AC output signal for the minus cosine function characteristic "−cosθ sinωt" determined by Equation (2), the signal denoted by cosθ sinωt may actually be generated and used as the AC output signal for the cosine function characteristic. If, however, the following phase detecting circuit (amplitude phase converting circuit) 42 uses the AC output signal for the cosine function characteristic for a subtraction in the form of "−cosθ sinωt", the AC output signal for the minus cosine function characteristic "−cosθ sinωt" may be directly used. Equation (2") can be executed instead of Equation (2) to actually generate the AC output signal for the cosine function characteristic "cosθ sinωt".

$$(V\alpha-VA)+(VC-VB)+(VD-V\beta) \qquad \text{Equation (2")}$$

A phase angle e in each of the sine and cosine functions which are amplitude components of each AC output signal corresponds to the detection target position, and a phase angle θ within a range of 90 degrees corresponds to the length K of one coil. Accordingly, the effective detection range corresponding to the length 4K corresponds to a range of phase angle θ between 0 and 360 degrees. Therefore, by detecting the phase angle θ, the detection target position within the length 4K can be absolutely detected.

Compensation for a temperature characteristic will be explained. An impedance of each coil varies depending on temperature, thereby varying the corresponding output voltages Vα, VA, VB, VC, VD, Vβ. For example, each voltage increases or decreases in a constant direction as shown by the broken lines in FIG. 11A compared to the solid curves therein. However, in the AC output signals sinθ sinωt and cosθ sinωt for the sine and cosine function characteristics, which are obtained by executing an addition or a subtraction on the above voltages, amplitude varies in both positive and negative directions as shown by the broken lines in FIG. 11B compared to the solid curves therein. When an amplitude coefficient A is used, these variations in amplitude are denoted by Asinθ sinωt and Acosθ sinωt. The amplitude coefficient A varies depending on ambient temperature and this variation appears similarly in the two AC output signals. Clearly, the amplitude coefficient A, indicating the temperature characteristic, does not affect the phase angle θ in the sine and cosine functions. Consequently, this embodiment automatically compensates for the temperature characteristic to enable accurate position detections.

By using the phase detecting circuit (or amplitude phase converting means) to measure the phase component θ of each of the amplitude functions sinθ and cosθ in the AC output signals sinθ sinωt and cosθ sinωt for the sine and cosine function characteristics, the detection target position can be absolutely detected. The phase detecting circuit 22 may be configured using the technique shown, for example, in the Japanese Unexamined Patent Application Publication Number 9-126809. Alternatively, the phase detecting circuit 22 may comprise a well-known R-D converter used to process resolver outputs.

As shown in FIG. 11B, the amplitude characteristics in the AC output signals sinθ sinωt and cosθ sinωt for the sine and cosine function characteristics do not indicate a true sine and cosine function characteristics if the correspondence between the angle e and the detection target position x is linear. The phase detecting circuit 42, however, carries out phase detections by assuming that the AC output signals sinθ sinωt and cosθ sinωt apparently have the amplitude characteristics of the sine and cosine functions, respectively. As a result, detected phase angle θ does not indicate linearity with respect to the detection target position x. Such a non-linearity between the detection output data (the detected phase angle θ) and the actual detection target position is not so important in position detections.

That is, the position has only to be detected with a predetermined reproducibility. In addition, an accurate linearity can be easily set between the detection output data and the actual detection target position by using an appropriate data conversion table to convert output data from the phase detecting circuit 42 as required. Thus, the AC output signal sinθ sinωt and cosθ sinθt having the amplitude characteristics indicating the sine and cosine characteristics, as used herein, need not indicate the true sine and cosine function characteristics but may actually be triangular waves as shown in FIG. 11B, in short, the signals have only to indicate tendencies corresponding to the true sine and cosine function characteristics. In the example in FIG. 11B, the viewpoint can be changed as follows: if the scale of the axis is considered to indicate θ an comprises a required non-linear scale, an apparently triangular wave obtained when the scale is considered to indicate x can be assumed to indicate the sine or cosine function with respect to θ.

Variations in the phase component e of the amplitude functions sine and cosine the AC output signals sinθ sinωt and cosθ sinωt for the sine and cosine function characteristics is not limited to those within the full range between 0 and 360 degrees but may be those within a narrower limited angular range. In the latter case, the configuration of the coils can be simplified. A narrower effective detection range may be used to detect minor variations, and in such a case, detectable phases may be within an appropriate range smaller than 360 degrees. This embodiment can be applied as appropriate to various other cases where the detectable phases may be within an appropriate range smaller than 360 degrees depending on the purpose of detections. Such variations are shown below.

Figure 12:
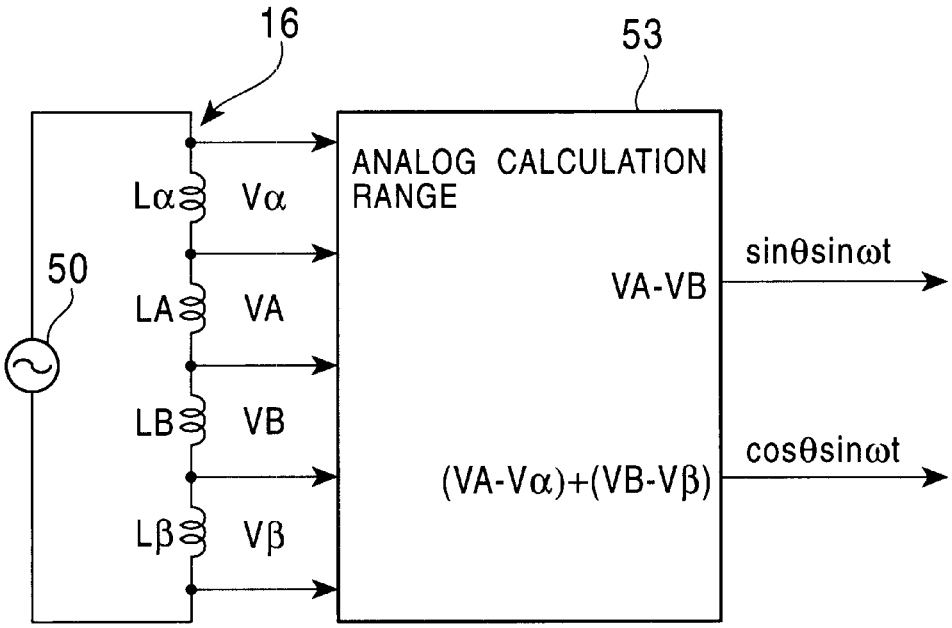
FIG. 12 is an electric circuit diagram associated with a coil section, showing a variation of the linear position detector.

FIG. 12 shows an example where phase is allowed to vary between 0 and 180 degrees. In this case, the winding section 16 is composed of the two coils LA, LB corresponding to the effective detection range and the supplementary coils Lα, Lβ provided before the coil LA and after the coil LB, respectively. An analog operation circuit 53 generates the AC output signal sinθ sinωt indicating the amplitude curve for the sine function characteristic by receiving inputs of the inter-terminal voltages Vα, VA, VB, Vβ of the coils and executing a calculation, for example, as shown in Equation (3). The analog operation circuit 53 generates the cosθ sinωt indicating the amplitude curve for the cosine function characteristic by executing an accumulation as shown in Equation (4).

$$VA-VB \qquad \text{Equation (3)}$$

$$(VA-V\alpha)+(VB-V\beta) \qquad \text{Equation (4)}$$

Figure 13:
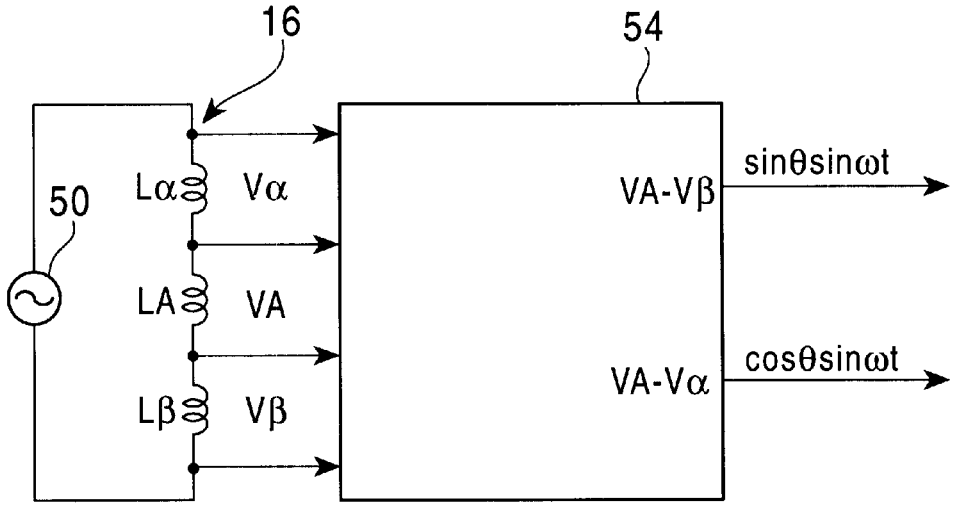
FIG. 13 is an electric circuit diagram associated with the coil section, showing another variation of the linear position detector.

FIG. 13 shows an example where phase is allowed to vary between 0 and 90 degrees. In this case, the winding section 16 is composed of the two coils LA, LB corresponding to the effective detection range and the supplementary coils Lα, Lβ provided before the coil LA and after the coil LB, respectively. An analog operation circuit 54 generates the AC output signal sinθ sinωt indicatingthe amplitude curve for the sine function characteristic by receiving inputs of the end-to-end voltages Vα, VA, Vβ of the coils and executing a calculation, for example, as shown in Equation (5). The analog operation circuit 54 generates the cosθ sinωt indicating the amplitude curve for the consine function characteristic by executing an accumulation as shown in Equation (6).

$$VA-V\beta \qquad \text{Equation (5)}$$

$$VA-V\alpha \qquad \text{Equation (6)}$$

Figure 14:
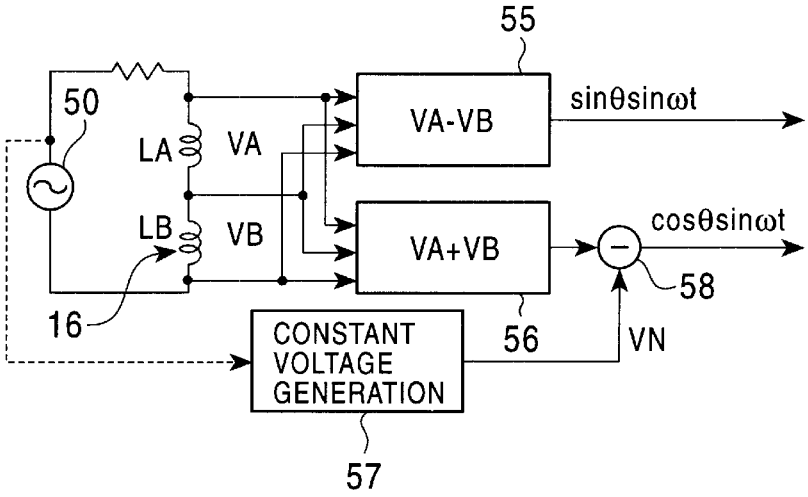
FIG. 14 is an electric circuit diagram associated with the coil section, showing yet another variation of the linear position detector.

In each of the above examples, the supplementary coils Lα, Lβ are provided before and after the effective detection range, respectively, but the supplementary coils Lα, Lβ may be omitted. FIG. 14 shows such an example where phase is allowed to vary between 0 and 180 degrees.

In this case, by using a subtraction circuit 25 to execute a subtraction on the end-to-end voltages VA, VB of the coils LA, LB, and AC output signal sinθ sinωt for the sine function characteristic can be generated as a result of the subtraction "VA−VB". In addition, by using an addition circuit 56 to execute an addition on the end-to-end voltages VA, VB of the coils LA, LB and then using a subtraction circuit 58 to subtract a constant voltage VN generated by a constant voltage generating circuit 57 from a result of the addition VA+VB, the AC output signal cosθ sinωt for the cosine function characteristic can be generated as a result of the subtraction "VA+VB−VN". The constant voltage VN generated by the constant voltage generating circuit 57 exhibits a temperature characteristic varying similarly to that of the coils LA, LB. Thus, the constant voltage generating circuit 57 may be constructed using a dummy coil having characteristics equivalent to those of the coil LA or the coil LB and excited by the same excitation AC signal.

Figure 15:
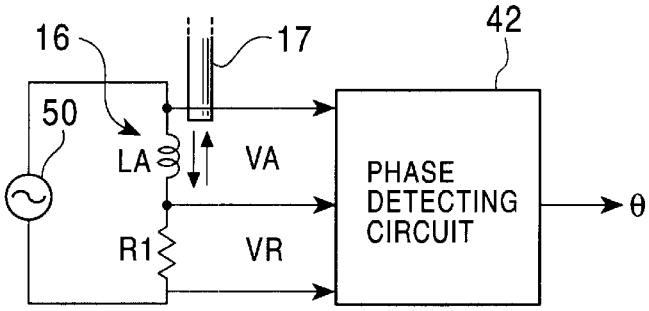
FIG. 15 is an electric circuit diagram associated with the coil section, showing still another variation of the linear position detector.

Another example of the linear position detector 13 has only one coil so as to correspond to the effective detection range. In this case, the range of phase variations within the effective detection range corresponding to the coil length K of the one coil is smaller than 90 degrees. FIG. 15 shows an example including one coil LA having a resistance element RI connected in series therewith. Thus, when an amplitude component of an inter-terminal voltage VA of the coil LA increases gradually in response to changes in the magnetic responding member 17, an amplitude component of an inter-terminal voltage drop VR of the resistance element RI decreases gradually. When the inter-terminal voltage VR of the resistance element RI is assumed to be the AC output signal sinθ sinωt for the sine function characteristic and the inter-terminal voltage VA of the coil LA is assumed to be the AC output signal cosθ sinωt for the cosine function characteristic, these signals can be correlated with characteristics within a certain angular range smaller than 90 degrees where the sine and cosine functions cross each other. By inputting these AC output signals to the phase detecting circuit 42, the corresponding phase angle θ within the angular range smaller than 90 degrees can be absolutely detected.

Figure 16:
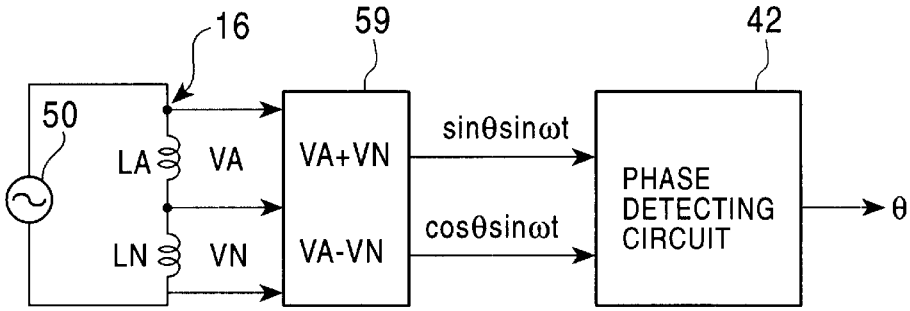
FIG. 16 is an electric circuit diagram associated with the coil section, showing yet another variation of the linear position detector.

FIG. 16 is a variation of FIG. 15 where a dummy coil LN replaces the resistance element RI. The dummy coil LN is connected in series with the detection coil LA, which is affected by the displacement of the magnetic responding member 17, but the dummy coil LN is not affected by the magnetic responding member 17. An operation circuit 59 calculates these voltages VA, VN in accordance with a predetermined operation expression and, for example, uses the calculation "VA+VN" to generate the AC output signal sinθ sinωt for the sine function characteristic, while using the calculation "VA−VN" to generate the AC output signal cosθ sinωt for the cosine function characteristic.

Figure 17:
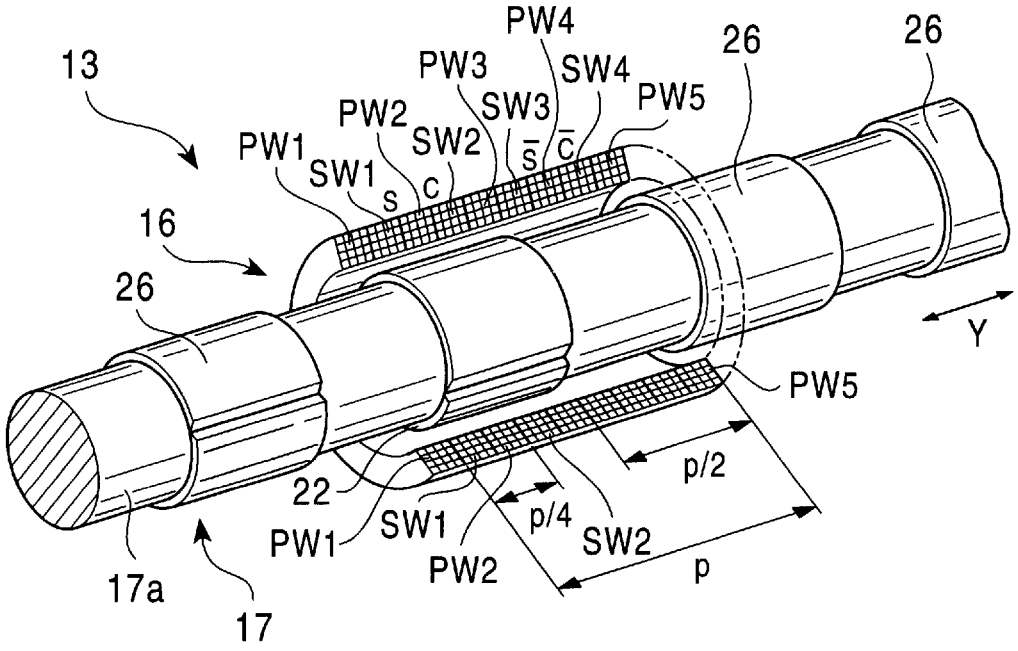
FIG. 17 is a cutaway perspective view showing yet another variation of the linear position detector.

FIG. 17 shows an example where the inductive linear position detector 13 uses a primary and secondary windings. This linear position detector 13 comprises a plurality of winding sections 16 each including primary windings subjected to a one-phase AC excitation and secondary windings arranged at different positions in the linear displacement direction as well as a plurality of magnetic responding member sections 26, the winding sections 16 and the magnetic responding member sections 26 being repeatedly arranged in the linear displacement direction at predetermined pitches. The linear position detector further comprises a magnetic responding member 17 for inducing an induced output AC signal in each secondary winding so as to have a different amplitude function characteristic depending on the offset of the location of the secondary coil, the induced output AC signal having its amplitude modulated depending on the linear position of the detection target. The induced output AC signal induced in each secondary winding has its amplitude function vary periodically using the repetition pitch of the magnetic responding members 26 as one cycle. The linear position detector 13 of this type is shown, for example, in the Japanese Unexamined Patent Application Publication Number 10-153402.

The magnetic responding member 17 includes a pin-shaped core section 17*a* and the plurality of magnetic responding member sections 26 arranged around the core section 17*a* at the predetermined pitches. The magnetic responding sections 26 are each a magnetic substance or a good conductor and may be a magnet. The material of the core section 17*a* is not particularly limited. In short, the magnetic responding member 17 has only to exhibit different magnetic responding characteristics for positions where the magnetic responding member section 26 is present and for positions where the magnetic responding member section 26 is absent.

The winding section 16 includes the primary windings PW1 to PW5 excited by a one-phase AC signal and the plurality of secondary windings SW1 to SW2 arranged at different positions in the linear displacement direction Y. The number of primary windings PW1 to PW5 may be one or an appropriate plural number and may be arranged as appropriate.

According to the linear position detector 13, the position of the magnetic responding member 26 of the magnetic responding member 17 relative to the winding section 16 changes in response to a change in the linear position of the detection target, so that the magnetic coupling between each of the primary windings PW1 to PW5 and the corresponding secondary winding SW1 to SW4 changes depending on the linear position of the detection target. Consequently, an induced output AC signal having its amplitude modulated depending on the linear position of the detection target is induced in each of the secondary winding SW1 to SW4 in such a manner as to have a different amplitude function characteristic depending on the offset of the location of the secondary winding SW1 to SW4. Since the primary winding PW1 to PW5 are commonly excited by the one-phase AC signal, the induced output AC signals inducted in the secondary windings SW1 to SW4 have the same electric phase and an amplitude function varying periodically using as one cycle, a displacement corresponding to one repetition pitch p of the magnetic responding member sections 26.

The four secondary windings SW1 to SW4 are arranged at predetermined intervals within the one repetition pitch p of the magnetic responding member sections 26 and set so that the amplitude functions of the induced output AC signals induced in the secondary windings SW1 to SW4 exhibit desired characteristics. If, for example, the position detector is configured to be of a resolver type, it is set so that the amplitude functions of the induced output AC signals induced in the secondary windings SW1 to SW4 correspond to the sine function, the cosine function, the minus sine function and the minus cosine function. For example, as shown in FIG. 17, the range of the one pitch p is divided into four so that the secondary windings are arranged at divided positions that are mutually offset by p/4. Thus, the linear position detector 13 can be set so that the amplitude functions of the induced output AC signals induced in the secondary windings SW1 to SW4 correspond to the sine function the cosine function, the minus sine function and the minus cosine function.

Figure 18:
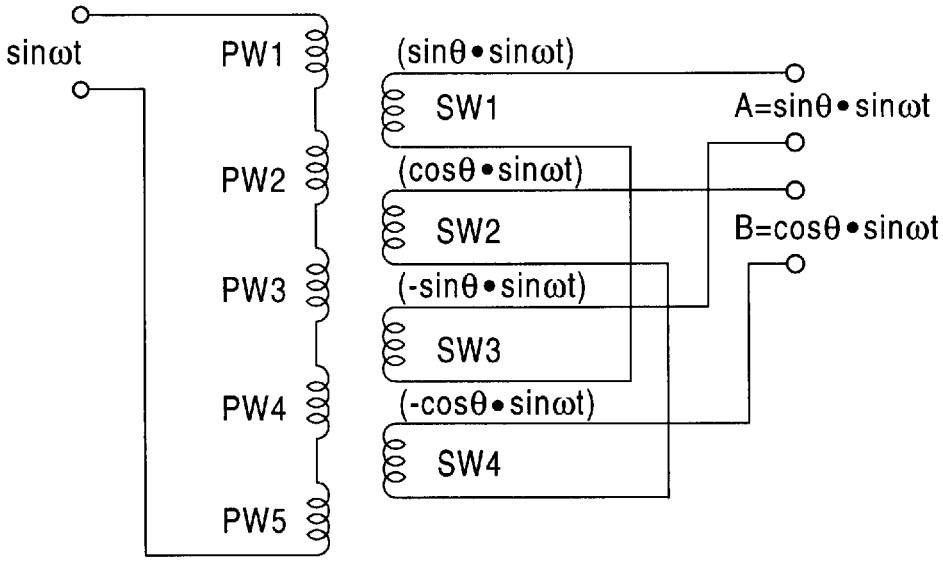
FIG. 18 is an electric circuit diagram of the linear position detector.

FIG. 18 is a circuit diagram of the winding section 16 wherein a common excitation AC signal (for the convenience of explanation, this signal is represented as $\sin\omega t$.) is applied to the primary windings PW1 to PW5. In response to the excitation of the primary windings PW1 to PW5, AC signals each having an amplitude value depending on the position of the magnetic responding member section 26 of the magnetic responding member 17 relative to the winding section 16 are induced in the corresponding secondary windings SW1 to SW4. The induced voltage levels indicate 2-phase function characteristics $\sin\theta$, $\cos\theta$ and negative-phase function characteristics $-\sin\theta$, $-\cos\theta$ corresponding to the linear position x of the detection target. That is, the induced output signals from the secondary windings SW1 to SW4 are output with their amplitudes modulated using the 2-phase function characteristics $\sin\theta$, $\cos\theta$ and negative-phase function characteristics $-\sin\theta$, $-\cos\theta$ corresponding to the linear position x of the detection target. $\theta$ is proportional to x and, for example, $\theta=2\pi\ (x/p)$. For the convenience of explanation, coefficients conforming to other conditions such as the number of windings are omitted, the secondary windings SW1 is defined to be a sine phase and the output signal therefrom is shown by "$\sin\theta\cdot\sin\omega t$", whereas the secondary winding SW2 is defined to be a cosine phase and the output signal therefrom is shown by "$\cos\theta\cdot\sin\omega t$". The secondary winding SW3 is defined to be a minus sine phase and the output signal therefrom is shown by "$-\sin\theta\cdot\sin\omega t$", whereas the secondary winding SW4 is defined to be a minus cosine phase and the output signal therefrom is shown by "$-\sin\theta\cdot\sin\omega t$". By differentially synthesizing the induced outputs of the sine and minus sine phases together, a first output AC signal ($2\sin\theta\cdot\sin\omega t$) having the amplitude function of the sine function is obtained. By differentially synthesizing the induced outputs of the cosine and minus cosine phases together, a second output AC signal ($2\cos\theta\cdot\sin\omega t$) having the amplitude function of the cosine function is obtained. For simplification, the coefficient "2" is omitted, so that the first output AC signal is hereafter represented by "$-\sin\theta\cdot\sin\omega t$", while the second output AC signal is hereafter represented by "$-\sin\theta\cdot\sin\omega t$".

Thus, outputs are obtained including the first output AC signal $A=-\sin\theta\cdot\sin\omega t$ having as an amplitude value the first function value $\sin\theta$ corresponding to a linear position y of the detection target and the second output AC signal $B=\cos\theta\cdot\sin\omega t$ having as an amplitude value the second function value $\cos\theta$ corresponding to the same linear position y of the detection target. It will be appreciated that this winding configuration allows the linear position detecting device to provide the two output in-phase AC signals (sine and cosine outputs) having the 2-phase AC amplitude functions, the signals being similar to those obtained in a known resolver that is a rotary position detecting device. Consequently, the 2-phase output AC signals ($A=\sin\theta\cdot\sin\omega t$ $B=\cos\theta\cdot\sin\omega t$) obtained in the linear position detecting device of this configuration can be used in the same manner as outputs from the known resolver. In addition, with the configuration where the four secondary windings SW1 to SW4 are arranged at the predetermined intervals within the one repetition pitch p of the magnetic responding member sections 26 as described above, the entire winding section 16 can be housed in a relatively small area substantially corresponding to the range of the one pitch of the magnetic responding member sections 26, thereby allowing the configuration of the linear position detecting device to be miniaturized.

As described above, the inductive linear position detecting device 13 configured as described above enables the 2-phase output AC signals ($A=\sin\theta\cdot\sin\omega t$ and $B=\cos\theta\cdot\sin\omega t$) to be output from the secondary windings SW1 to SW4 of the winding section 16 as in the rotary -type resolver. Consequently, an appropriate digital phase detecting circuit can be applied to detect the phase value θ of the sine function sinθ and cosine function cosθ by means of digital phase detection in order to obtain position detection data on the linear position x based on the phase value θ.

Figure 19:
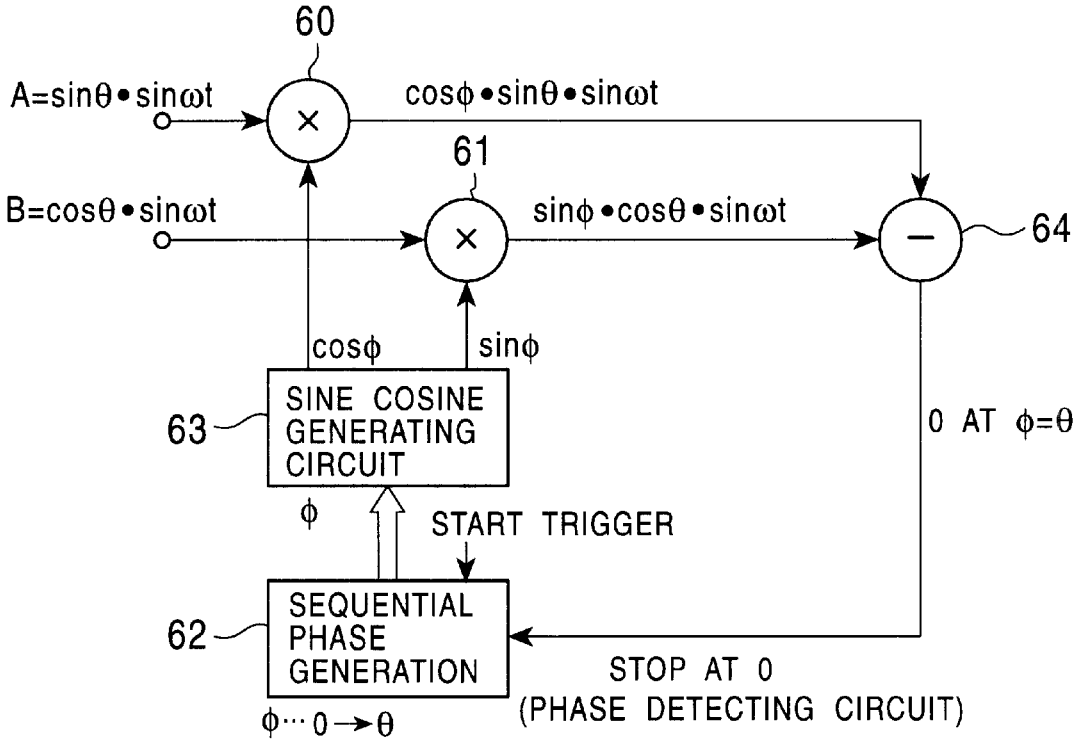
FIG. 19 is a block diagram showing an example of a measurement circuit of the linear position detector.

For example, FIG. 19 shows an example where a well-known R-D (resolver-digital) converter is applied. the resolver-type 2-phase output AC signals A=sinθ·sinωt and B=cosθ·sinωt output from the secondary windings SW1 to SW4 of the winding section 16 are input to analog multipliers 60, 61. A sequential phase generating circuit 62 generates digital data for a phase angle ø, and sine cosine generating circuit 63 generates an analog signal for a sine value sine ø and a cosine value cos ø corresponding to the phase angle ø. A subtractor 64 determines the differences between output signals from the multipliers 60, 61 so that an output from the subtractor 64 controls a phase generating operation performed by the sequential phase generating circuit 62. When the output from the subtractor 64 becomes zero, digital data for the phase angle θ are obtained.

Figure 20:
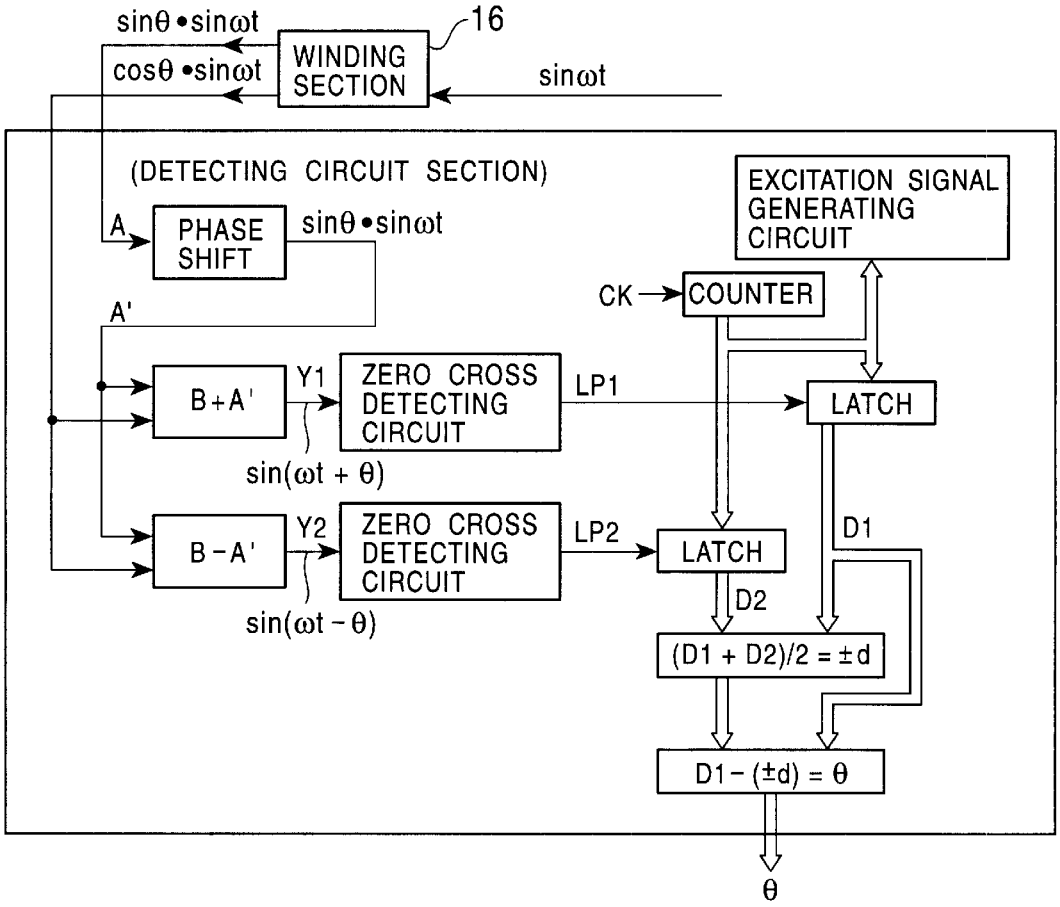
FIG. 20 is a block diagram showing another example of a measurement circuit of the linear position detector.

A variation in temperature or the like may change the impedances of the primary and secondary windings to cause an error in an electric AC phase ωt of the secondary output AC signal. In the above described phase detecting circuit, however, the phase error in sinωt is automatically offset. FIGS. 20 shows another example of a phase detecting circuit applied to the above described inductive linear position detecting device 13. This example is shown in the above described publication (the Japanese Unexamined Patent Application Publication Number 10-153402) and its description is omitted.

Figure 21:
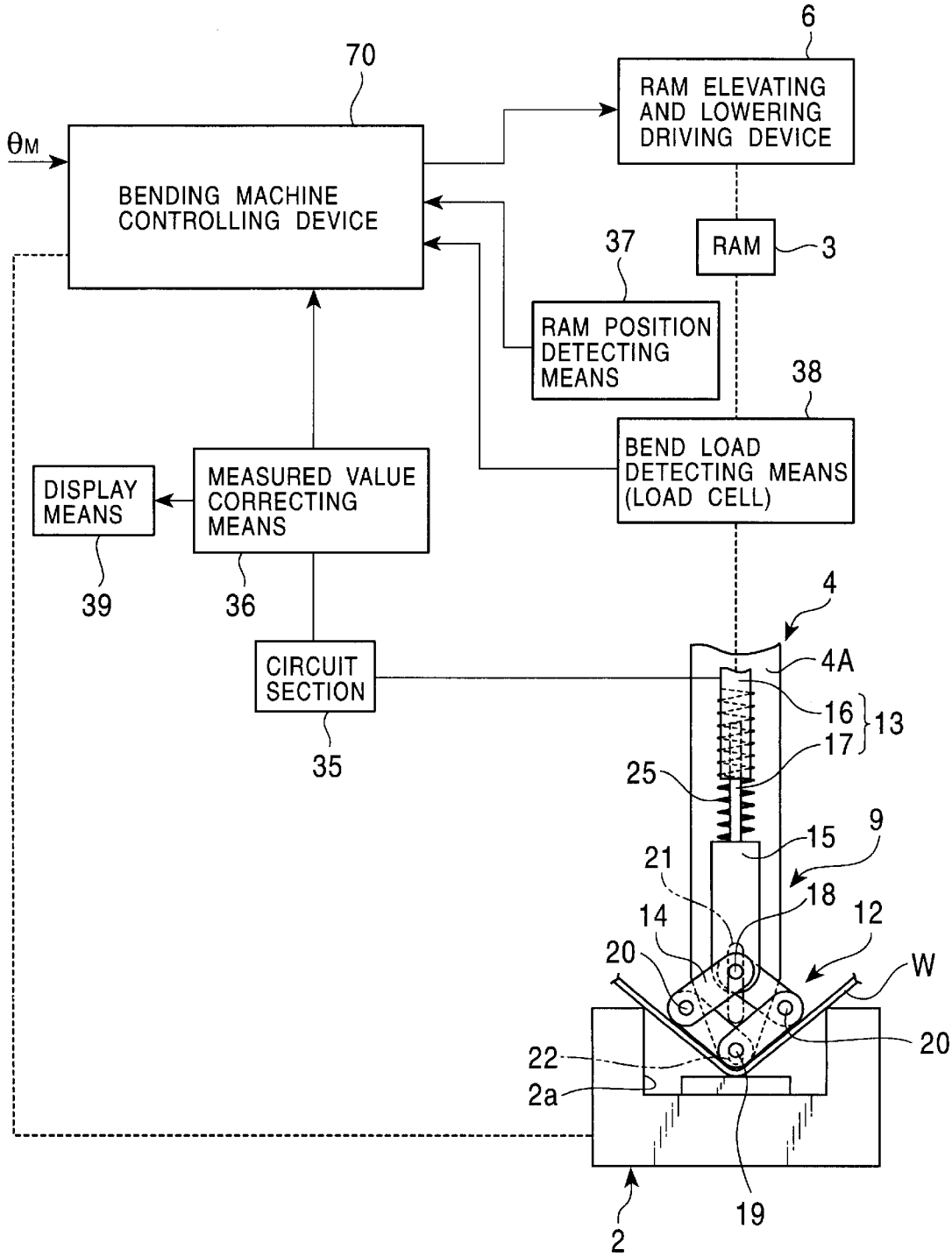
FIG. 21 is a block diagram showing an example of a control system for the bending machine.

Next, an example of a control system for the bending machine will be explained in connection with FIG. 21. A bending machine controlling device 70 is means for controlling a bending operation performed by the bending machine and has a numerical control function or the like. The bending machine controlling device 70 controls bending while measuring the bend angle using the angle measuring instrument. An output from a circuit section 35 of the angle measuring instrument 9 is input to the bending machine controlling device 70 via a measured value correcting means 36.

The measured value correcting means 36 has a processing function for converting a measured value for the linear position obtained by the circuit section 35 of the linear position detector 13, into angle data. During the conversion into angle data, corrections are made based on the characteristics of the corner contacting member 12. Since the upper support pin 18 and lower support pin 19 of the corner contacting member 12 can be moved in the vertical direction, the relationship between the measured value from the linear position detector 13 and the angle value is not proportionality but corresponds to a predetermined characteristic curve. Corrections are thus made depending on this characteristic curve. The bend angle obtained by the measured value controlling means 36 is displayed on display means 30 of the bending machine controlling device 70.

Figure 22:
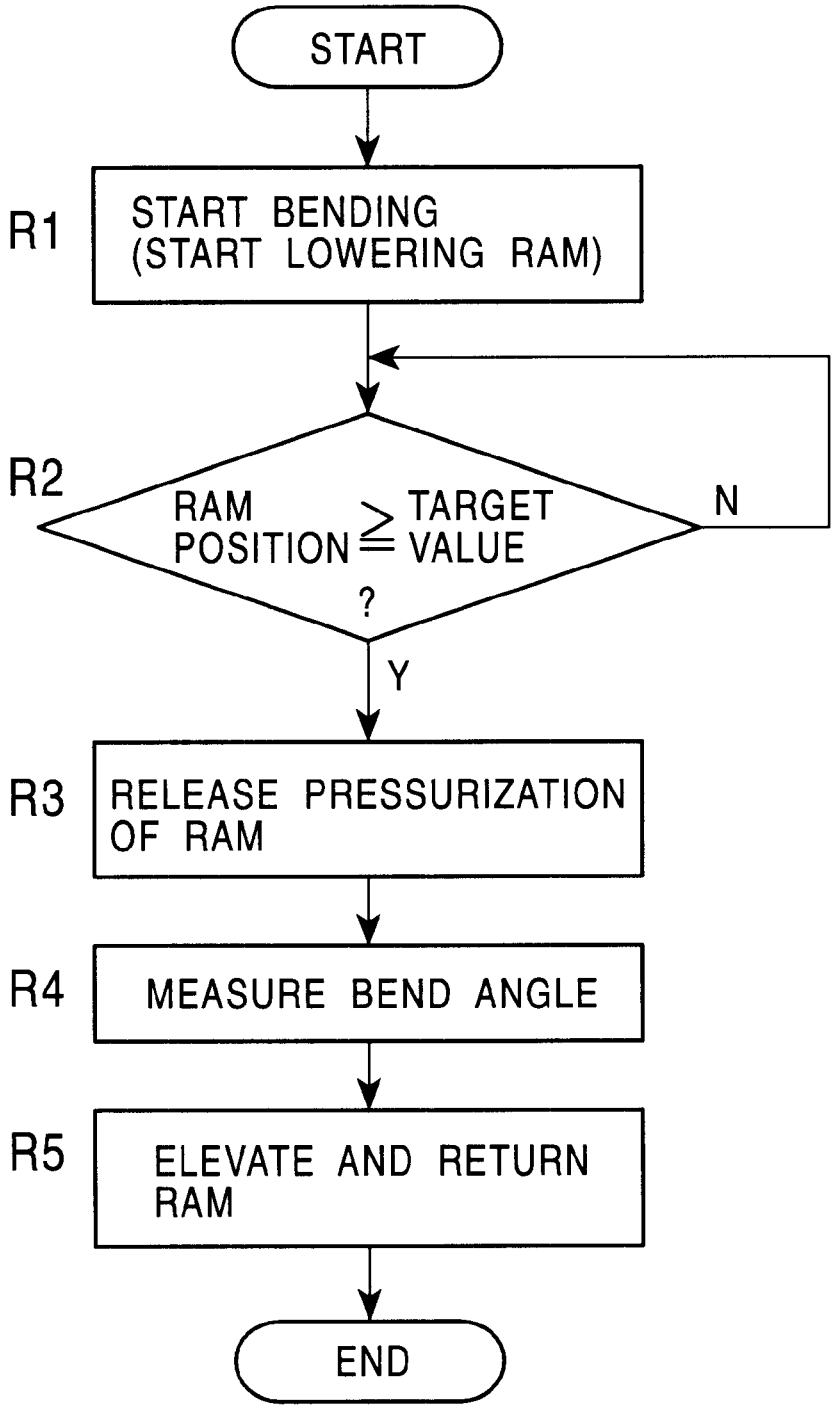
FIG. 22 is a flow chart showing a method executed by the control system to operate the bending machine.
Figure 23:
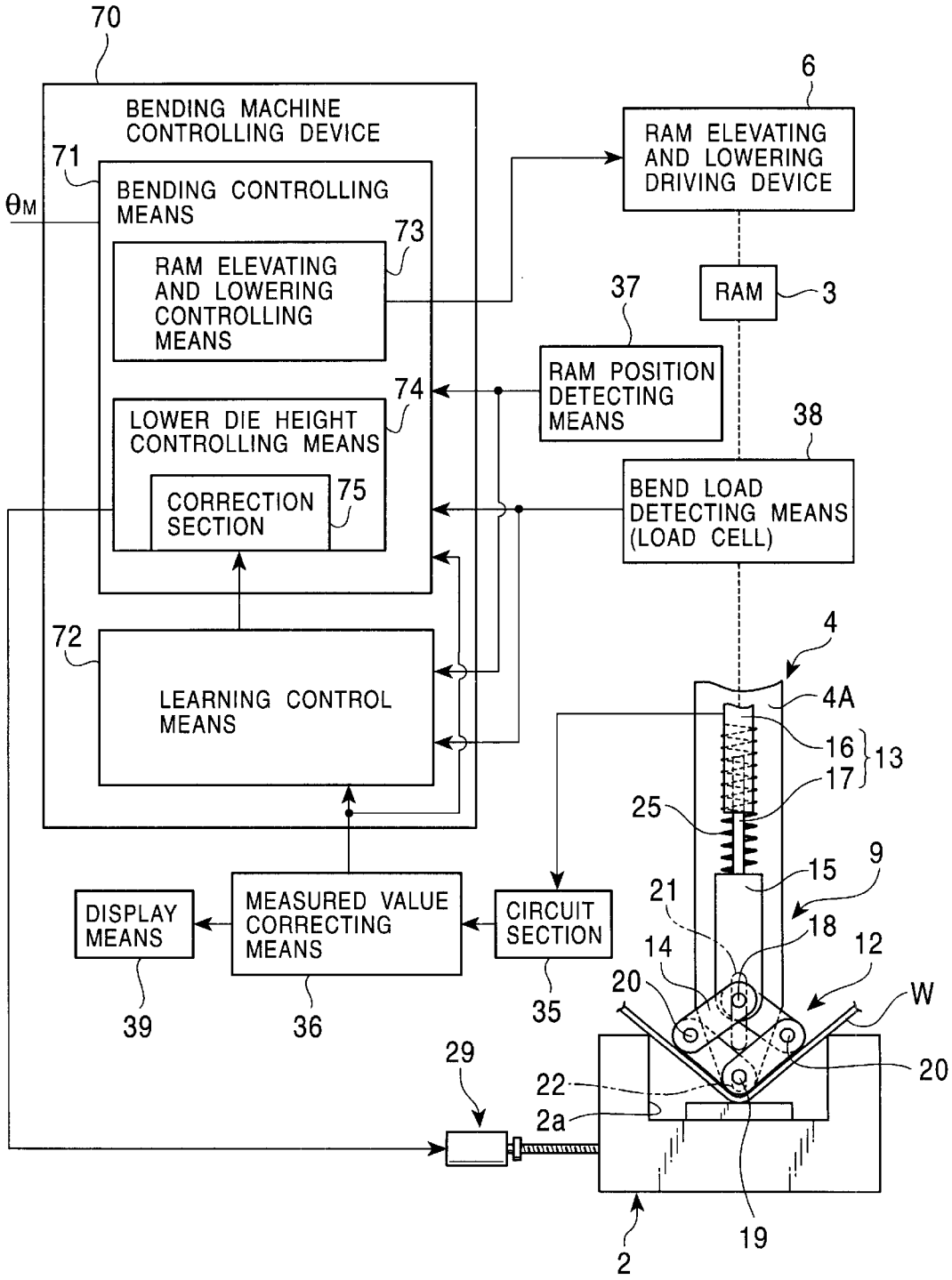
FIG. 23 is a block diagram showing another example of the control system for the bending machine.

A method for operating this bending machine and an operation for measuring the bend angle of the work will be described in brief in connection with FIG. 22. First, the ram 3 is lowered to start bending (R1). The upper die 4 enters the lower die 2, so that the work W is bent between the upper die 4 and the lower die 2. If the lower die 2 is for three-point bending as shown in FIG. 7, the upper die 2 is lowered down to the lowest position possible. That is, the upper die 2 is lowered to bend the work W until the bent work W comes in contact with the bottom surface of the lower die 2, and then the ram 3 is elevated (R2). If the lower die 2 is for air bending as shown in FIG. 8, the upper die 2 is lowered down to a position (an overstroke target value) that is a predetermined overstroke amount lower than the upper die 2, the height of which corresponds to the target value of the bend angle, and then the ram 3 is elevated. In the meantime, bending is carried out while using the angle measuring instrument 9 to measure the bend angle of the work W.

To measure the bend angle after the work W has sprung back, the pressurization of the ram 3 by the ram elevating and lowering driving means 6 is released (R3), and the angle measuring instrument 9 measures the end angle of a bent portion of the work W after actual spring back resulting from the release of pressuization (R4). After the measurement, the ram 3 is elevated and returned (R5).

Figure 6A:
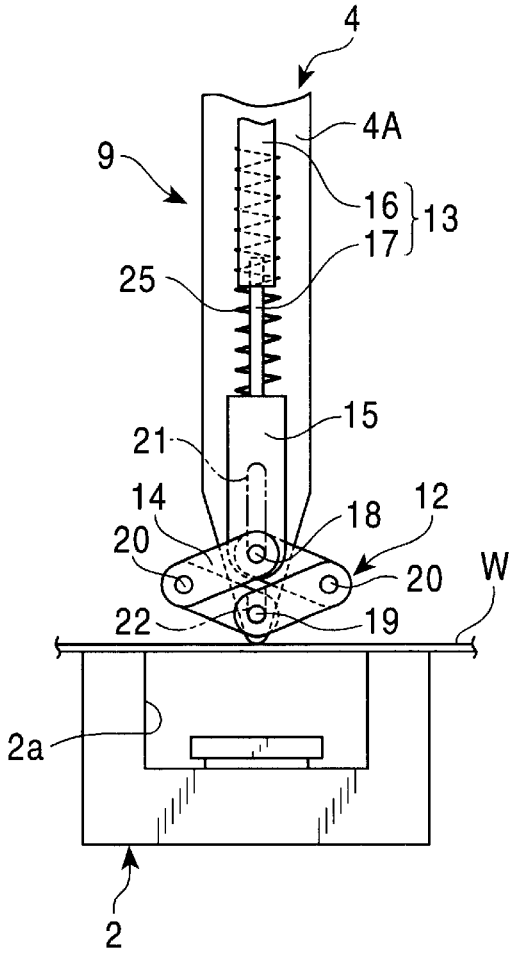
FIG. 6 is a view useful in explaining the operation of the angle measuring instrument.
Figure 6B:
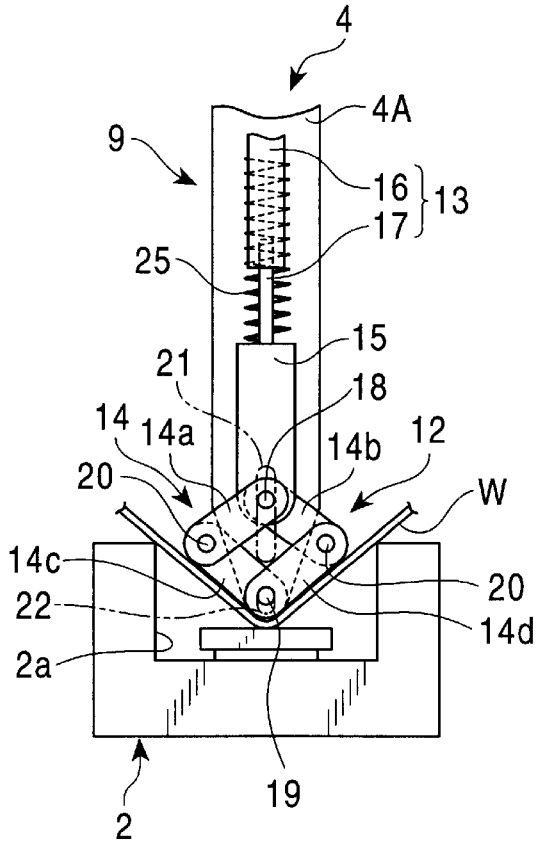

The angle measuring instrument 9 measures the angle as shown in FIG. 6. As shown in FIG. 6A, since the corner contacting member 12 comprising the parallel links have the linearly displaced part 15 urged downward by the returning elastic body 25 until it enters the bent portion, both the upper support pin 18 attached to the linearly displaced part 15 and the lower support pin 19 provided below the upper support pin 18 away from a linearly displaced part 15 are pressed against lower ends of the slot-shaped guides 21, 22 both formed in the upper die 4. Accordingly, the corner contacting member 12 have the parallel links in a flat form.

Once the upper die 4 has entered the lower die 2 and the bending has progressed to some degree, the angle measuring instrument 9 advances into the bent portion of the work W with the upper die 4, and sides of two lower links 14*c,* 14*d* of the corner contacting member 12 comprising the parallel links moves along the corresponding surfaces of the recessed corner of the work W. Accordingly, the corner contacting member 12 is deformed against an elastic recovery force of the returning elastic body 25 in such a manner that the breadth of the parallel links decreases. This deformation causes elevation of the linearly displaced part 15 having the upper support pin 18 of the corner contacting device 25 fixed thereto. At this point, since the lower support pin 19 can move in the vertical direction within the guide 22, it rises as the bend angle grows acute. Consequently, the linearly displaced part 15 rises an amount based on a predetermined relation curve through this amount is not proportional to the bend angle of the work W.

The linear position detector 13 detects the elevation of the linearly displaced part 15 as the elevation of the rod-shaped magnetic responding member 17, and the measured value correcting means 36 (FIG. 21) converts the detected value of linear position displacement into a bend angle. The bend angle is measured in this manner.

A control system for learning control for the three-point bending machine will be described in connection with FIGS. 23 to 26.

The bending machine controlling device 70 comprises bending controlling means 71 and leaning controlling means 72. The learning control means 71 controls the entire bending machine and comprises a computerized numerical control device (not shown in the drawings) for controlling the bending machine in accordance with a processing program (not shown in the drawings), a programmable controller, a ram elevating and lowering controlling means 73, and a lower die height controlling means 74. The ram elevating and lowering controlling means 73 provides a drive command for the ram elevating and lowering driving device 6 to cause the ram 3 to perform predetermined elevating and lowering operations in accordance with the target value of the bend angle. The ram elevating and lowering controlling means 73 controls elevation and lowering while monitoring a detected value from the ram position detecting means 37 for detecting a stroke position of the ram 3, a bend load detected by bend load detecting means 38, and the measured value of the bend angle from the angle measuring instrument 9. The bend load detecting means 38 comprises a pressure detecting means, a load cell, or the like which is provided in a ram cylinder constituting the ram elevating and lowering driving means 6. The load cell is provided in the upper die 4 or the ram 3. The lower die height controlling means 74 controls the height of the variable bottom 2*aa* of the lower die 2 and provides a height adjustment command to the lower die height adjusting means 29. The lower die height controlling means 74 has a correction section 75 having a function for correcting the height of the bottom surface of the lower die corresponding to the target angle $\theta_M$, in accordance with an externally provided correction value.

The learning control means 72 generates a correction value from various measured values obtained during the bending process to provide it to the bending controlling means 71, and provides the correction value 75 with a next correction value for the lower-die bottom surface height.

Figure 25:
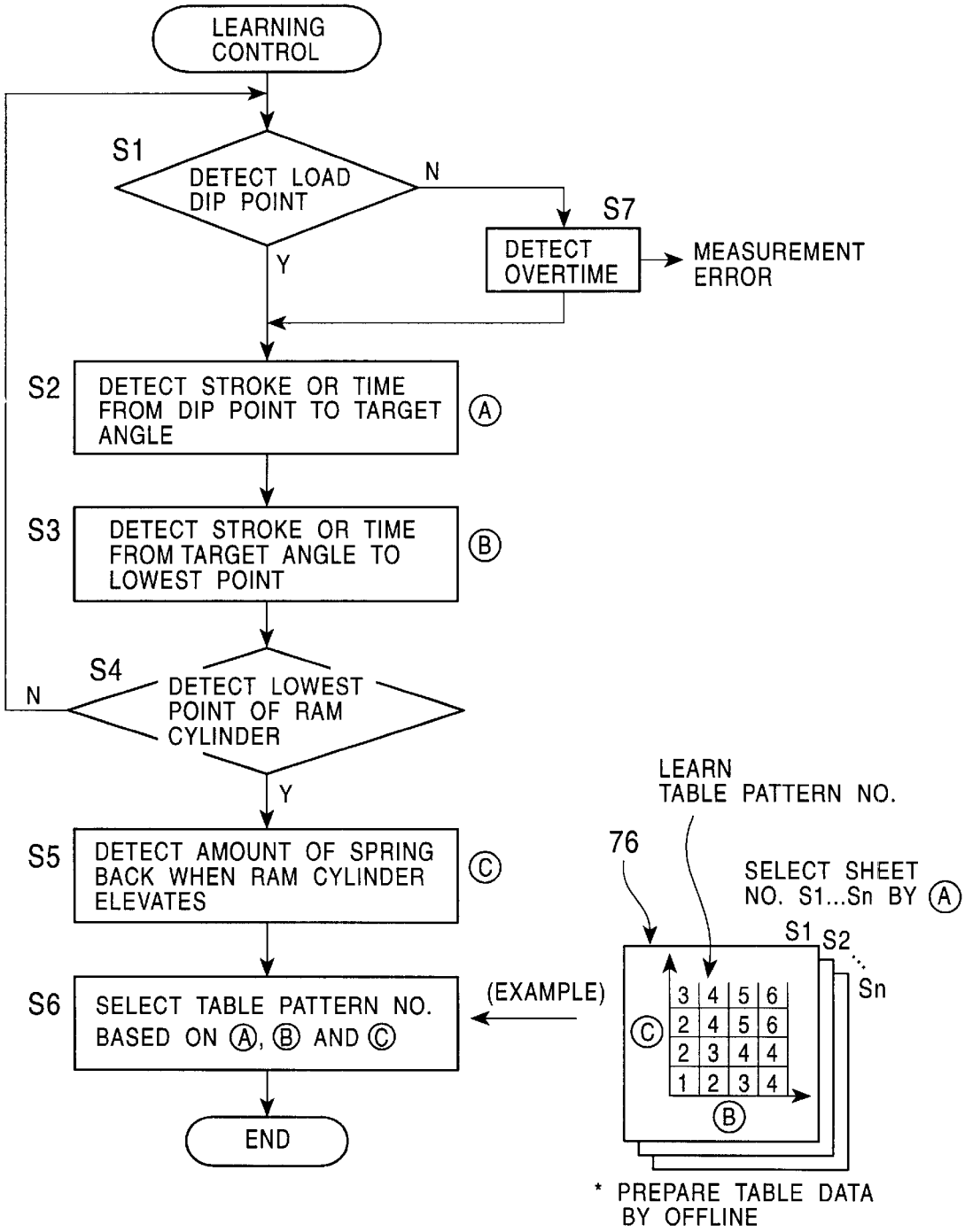
FIG. 25 is a flow chart of learning control effected by the control system.

The learning control means 72 carries out the processing shown in the flow chart in FIG. 25 in order to generate the next correction value, and has a pattern table 76, a bending process measuring means 77, a product bend angle measuring means 78, and a correction value generating means 79.

The pattern table 76 is storage means wherein the interrelationship between elevated and lowered positions of the upper die 4, a load acting thereon, and the bend angle of the work W which all occur during the bending process is classified into a plurality of patterns so that a pattern number can be selected depending on the interrelationship. The bending process measuring means 77 measures the elevated and lowered positions of the upper die 4, the load acting thereon, and the bend angle of the work W, during the bending process, and has a load dip point detecting means 80 and a ram cylinder motion detecting means 81. The correction value generating means 79 comprises a pattern detecting section 82 and a correction value generating means 83. The correction value generating means 83 stores correction value conversion data 84 for each pattern set by the pattern detecting means 82, the data being used to provide a next correction value θh for the lower die bottom surface height corresponding to the product bend angle (bend angle after spring back). The correction value conversion data 84 may be a relational expression or a table. The product bend angle detecting means 78 has an angle detecting means 85 for loading the angle after spring back using a predetermined timing, and a ram cylinder control means 86.

A method for operating a bending machine that uses the learning control means 72 for learning control will be described.

Figure 26:
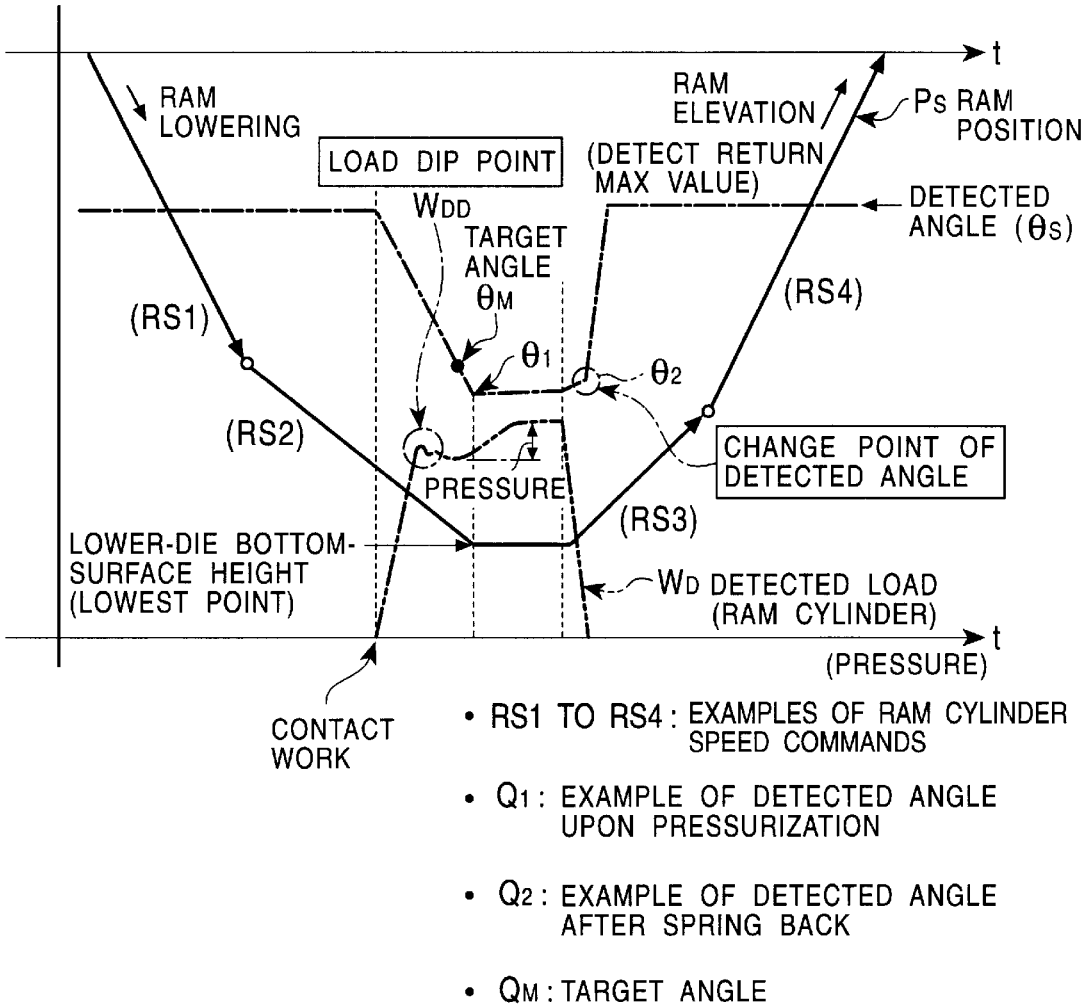
FIG. 26 is a graph showing the relationship among various signals provided during learning control executed by the control system.

First, command and measured values provided by corresponding sections during a single bending process will be explained in connection with FIG. 26.

A stroke position (Ps) of the ram 3 lowers from an elevated standby position to a lower die bottom surface height position (lowest point) and then elevates and returns to the elevated standby position. The lower die bottom surface height position is such that the upper die 4 presses the work W against the lower die 2. As shown by examples of speed commands RS1 to RS4 issued during each process of the ram cylinder constituting the ram elevating and lowering driving device 6, the ram 3 lowers, during a lowering process, to a predetermined height closer to the lower die 2 at a high speed, then switches to a lower speed to continue lowering, stops at the lowest point for a predetermined period of time while pressurizing the work, subsequently elevates at a low speed, and then switches to a higher speed and rises to the elevated standby position. During this process, the ram cylinder reduces the pressure down to a certain value (a cushion pressure) upon shifting to an elevating operation from the lowest point.

A detected bend angle θs is equal to or smaller than 180 degrees when the ram 3 lowers and brings the upper die 4 into contact with the work W on the lower die 2 to start bending, and then decreases gradually. When the ram 3 reduces the pressure at the lowest point or rises slightly, the detected angle θs increases slightly due to spring back of the work W. Subsequently, the detected angle θs returns gradually to 180, which is the initial value, until the upper die 4 is separated from the lower die 2, because the corner contacting member 12 of the angle measuring instrument 4 exerts a reduced pressure on the work W.

A load $W_D$ (the weight of the ram cylinder) detected by the bend load detecting means 38 occurs when the ram 3 lowers to bring the upper die 4 into contact with the work W, and decreases rapidly as bending progresses to enter a yield state. The point at which the load starts to lessen is called a "load dip point" $W_{DD}$. After the decrease in load, the upper die 4 is pressed against the bottom surface of the lower die 2, so that the detected load $W_D$ increases again. Subsequently, the detected load $W_D$ lessens gradually down to zero until the ram 3 rises to separate the upper die 4 from the lower die 2.

Figure 24:
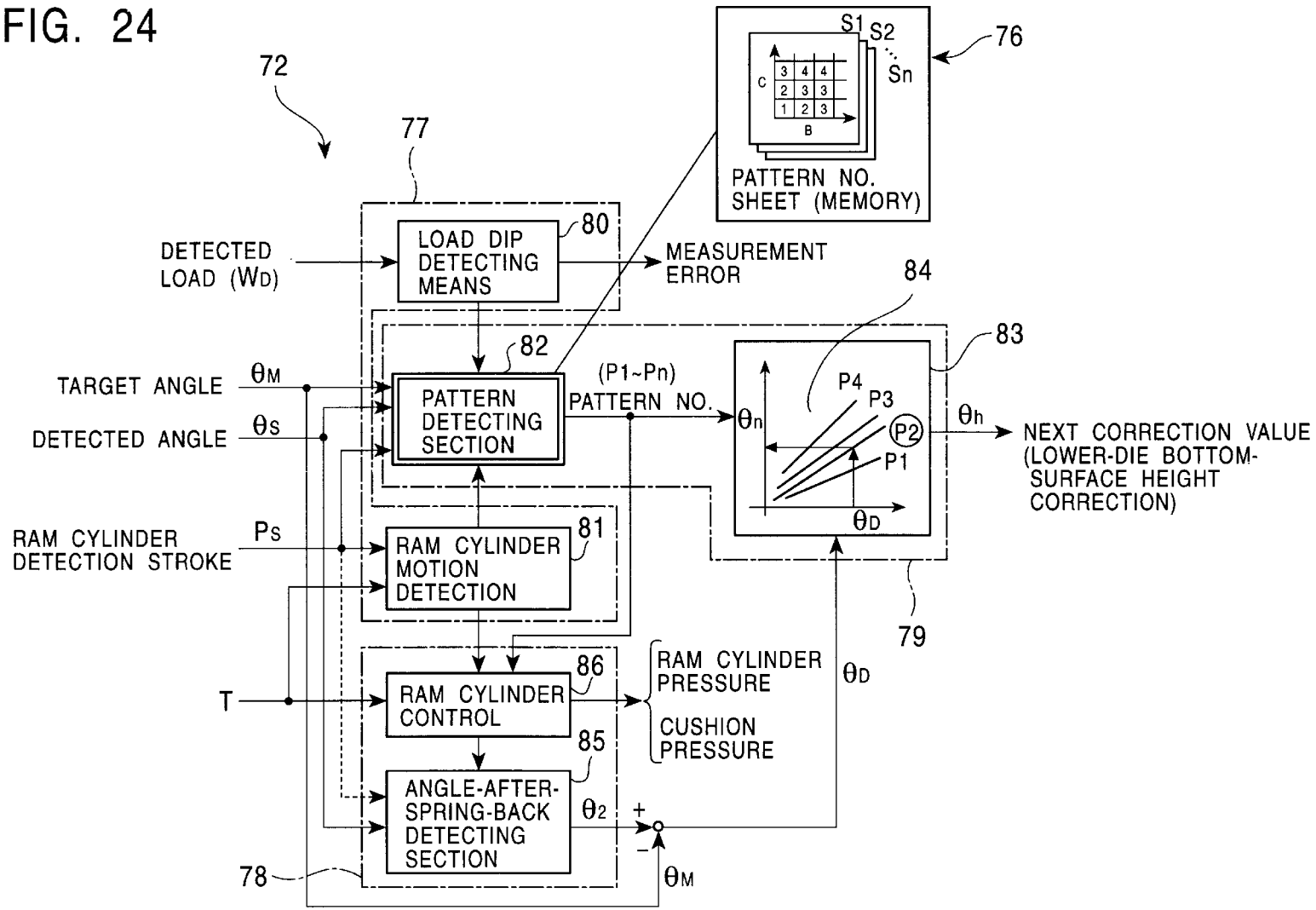
FIG. 24 is a block diagram of learning control means of the control system.

As shown by the flow chart the FIG. 25, with the learning control, while the ram 3 is descending, the load dip detecting means 80 monitors the detected load $W_D$ to detect the load dip point $W_{DD}$ (step S1). The load dip point and lowest point of the ram cylinder 3 are monitored until the lowest point is detected (S1, S4). In the meantime, the amount of stroke of time (a measured amount A) of the ram cylinder from the load dip point to the target angle $\theta_M$ is detected (S2), and the amount of stroke or time (a measured amount B) of the ram cylinder from the target angle $\theta_M$ to the lowest point is detected (S3). An overtime detecting process (S7) is used to monitor whether the load dip point has been detected within a predetermined period of time, and a signal for a measurement error is output in the case of overtime. Once the ram 3 has reached the lowest point, the amount of spring back (a measured amount C) is detected (S5) when the ram 3 elevates. The amount of spring back is detected as a difference between a detected angle (the product bend angle) $\theta_2$ after spring back obtained by the angle measuring instrument 85 and a detected angle $\theta_1$ obtained when the work W is pressed against the lower die 2. In FIG. 24, means for calculating the amount of spring back is omitted. Based on the measured amounts A to C thus obtained, the pattern detecting section 82 in FIG. 24 selects a corresponding pattern from the pattern table 76 and communicates a recognition code (a pattern number) for the selected pattern to the correction value generating section 83.

The pattern selection will be specifically described. The pattern table 76 is prepared offline or in another manner before starting learning control. This preparation is based on results of measurements in past bending operations, experimental values, simulation results, or the like. Specifically, the pattern table 76 is created as a group of pattern number sheets (S1 to Sn) constituting individual tables for the corresponding amounts of stroke or time (the measured amount A) from the load dip point $W_{DD}$ to the target angle $\theta_M$. A single pattern number sheet has recorded thereon a pattern number (1, 2, . . . ) determined from the relationship between the amount of stroke or time (the measured amount B) from the target angle $\theta_M$ to the lowest point and the amount of spring back (the measured amount C). The pattern detecting means 82 in FIG. 24 first selects a corresponding pattern number sheet based on the measured amount A and selects a pattern number (1, 2, . . . ) determined from the measured amount B and the measured amount C.

The correction value generating section 83 has a relation curve between a bend angle error ($\theta_n$) and the next correction value θh set for each pattern as the correction value conversion data 84. The detected angle (the product bend angle) $\theta_2$ after spring back obtained by the angle detecting section 85 is compared with the target angle ($\theta_M$) to obtain the bend angle error ($\theta_n$). The correction value generating section 83 then converts the bend angle error into the next correction value θh based on the relation curve for the corresponding pattern. The next correction value θh thus generated is input to the correction section 45 of the lower die height controlling means 44 of the bending controlling means 41. The next bending is carried out with the height of the lower die controlled, relative to the target value of the bend angle, to a value determined through a correction with the next correction value θh. The next correction value θh may be directly used for a correction or may be statistically processed with results for the next correction value θh or appropriate measurement results obtained during a plurality of bending operations. In this manner, learning control is effected for the three-point bending. The correction based on the learning control is made, for example, when the target value of the bend angle or the thickness or material of the work is changed. To repeat the processing under the same conditions, the learning control function is not used.

Figure 27:
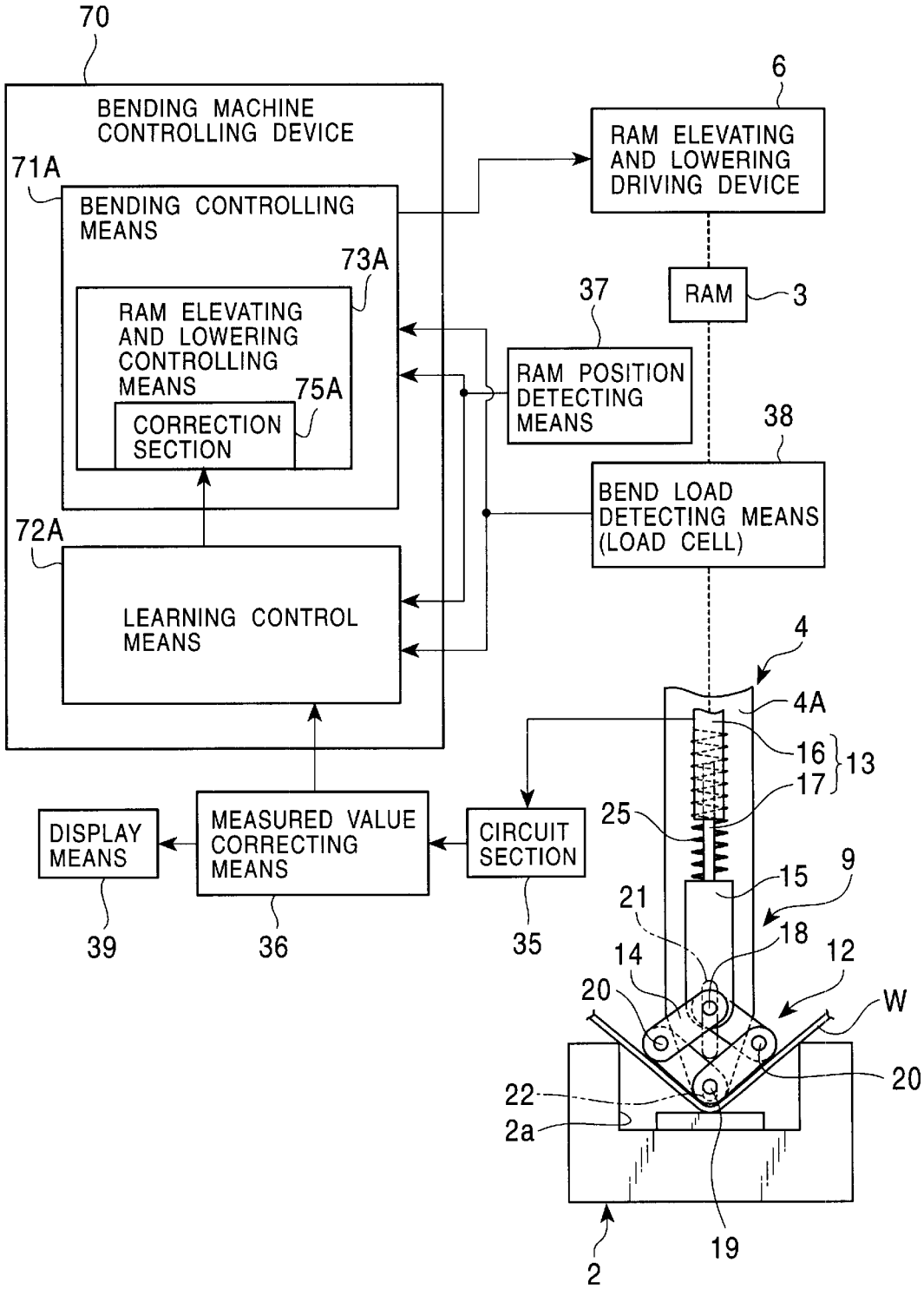
FIG. 27 is a block diagram showing yet another example of the control system for the bending machine.

A control system for carrying out learning control for an air bending machine will be described in connection with FIGS. 27 to 29.

The bending machine controlling device 70 comprises a bending controlling means 71A and a learning control means 72A. The bending controlling means 71A is composed of a computerized numerical control device and a programmable controller which effect control in accordance with a processing program as in the example in FIG. 23. The bending controlling means 71A has a ram elevating and lowering controlling means 73A but not the lower die height controlling means 74 as shown in the example in FIG. 23, and the ram elevating and lowering controlling means 73A has a correction section 75A. The ram elevating and lowering controlling means 73A controls elevation and lowering while monitoring a detected value of the stroke position from the ram position detecting means 37, a detected value of the bend load from the bend load detecting means 38, and a detected value of the bend angle from the angle measuring instrument 9. The correction section 75A has a function for correcting the overstroke target value corresponding to the target angle in accordance with an externally provided correction value.

Figure 28:
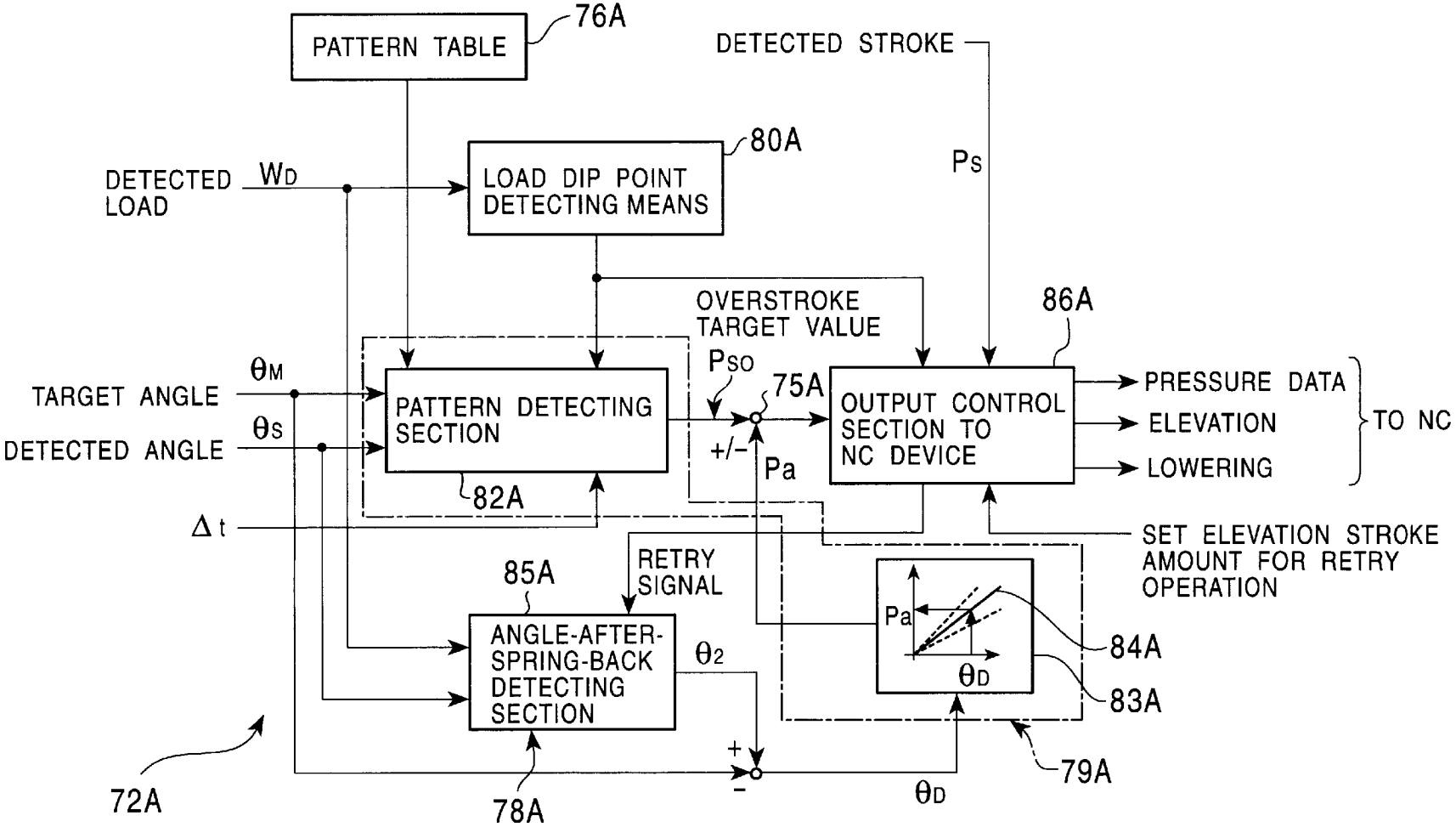
FIG. 28 is a block diagram of learning control means of the control system.
Figure 29:
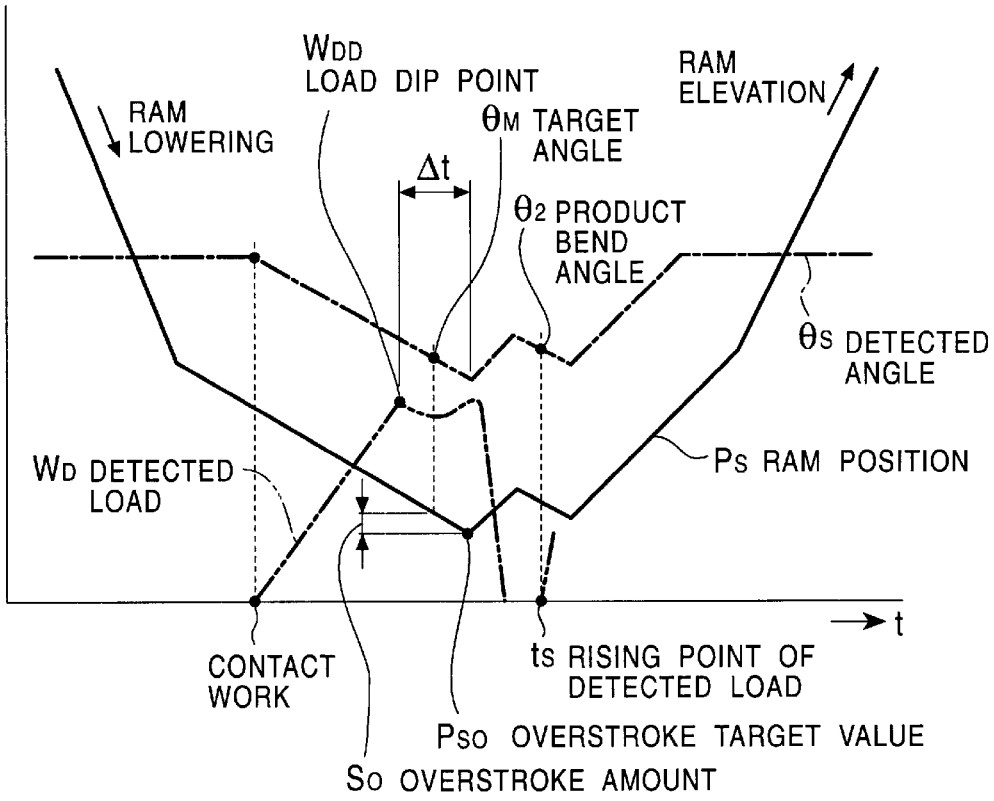
FIG. 29 is a graph showing the relationship among various signals provided during learning control executed by the control system.

The learning control means 72A has a pattern table 76A, a load dip detecting means 80A, a pattern detecting section 82A, an angle-after-spring-back detecting section 78A, a correction value generating section 83A and a output-to-NC-device control section 86A, as shown in FIG. 28. The pattern detecting means 82A and the correction value generating section 83A constitute a correction value generating means 79A. In order to measure the angle after spring back, the output-to-NC-device control section 86A has a function for causing the ram 3 to perform an operation (retry) of elevating a predetermined height from the overstroke target value, subsequently lowering, and then shifting to an elevating and returning operation, as described later. A portion of the output-to-NC-device control section 86A comprising this function and an angle detecting means 85A constitute the product bend angle measuring means 78A. The NC device refers to a portion of the bending machine means which effects numerical control.

The pattern table 76A is prepared offline or in another manner before starting learning control. This preparation is based on results of measurements in past bending operations, experimental values, simulation results, or the like. Specifically, the pattern table 76A contains classified patterns for the corresponding amounts of stroke in this example, time is substituted for this amount,) from the load dip point $W_{DD}$ to the target angle $\theta_M$.

The correction value generating section 83A has a relation curve between the error $\theta_n$ between the product bend angle $\theta_2$ and the target angle $\theta_M$ and a next correction value Pa for an overstroke target value Pso set for each pattern as the correction value conversion data 84.

Functions of the other sections will be explained in connection with the following description of an operation method.

A method for operating a bending machine that uses the learning control means 72A for learning control will be described. First, the operation of each section, measured values, and the like which occur during a single operation will be explained with FIG. 29.

In a fashion drawing a curve of a ram stroke position Ps, the ram 3 lowers from an elevated standby position such as a top dead center to the overstroke target value Pso, subsequently elevates and lowers again, and then arises to the elevated standby position, in order to detect the bend angle after the work W has sprung back.

The detected bend angle θs is equal to or smaller than 180 degrees when the ram 3 lowers and brings the upper die 4 into contact with the work W on the lower die 2 to start bending, and then decreases gradually until the ram 3 reaches the overstroke target value Pso. Subsequently, the detected angle θs returns gradually to 180 degrees, which is the initial value, until the upper die 4 is separated from the lower die 2, because the corner contacting member 12 of the angle measuring instrument 9 exerts a reduced pressure on the work W. Relations with spring back will be described later.

The detected load $W_D$ (the weight of the ram cylinder) detected by the bend load detecting means 38 occurs when the ram 3 lowers to bring the upper die 4 into contact with the work W, and decreases rapidly as bending progresses to enter a yield state. The point at which the load starts in lessen is called the "load dip point" $W_{DD}$. After the decrease in load, the upper die 4 reaches the overstroke target value Pso and then starts rising, while the detected load $W_D$ increases temporarily due to a characteristic of plastic processing. The detected load $W_D$. however, lessens gradually down to zero until the ram 3 rises further to separate the upper die 4 from the lower die 2.

The load dip point detecting means 80A of the learning control means 72A in FIG. 28 monitors the detected load $W_D$ to detect the load dip point $W_{DD}$. The pattern detecting section 82A monitors a detection signal from the load dip point detecting means 80A, the detected angle θs from the angle measuring instrument 9, and time to detect the amount of time Δt from detection of the load dip point $W_{DD}$ until the detected angle θs reaches the target angle $\theta_M$. The amount of time Δt indirectly indicates the amount of stroke from detection of the load dip point until the detected angle θs reaches the target angle $\theta_M$. The pattern detecting section 82A checks the thus detected amount of the time Δt (ram stroke) against the pattern table 76A to select a bending characteristic pattern. The pattern detecting section 82A further outputs the next overstroke target value Pso depending on the defected amount of time Δt (ram stroke).

The product bend angle measuring means 78 monitors the detected angle θs and the detected load $W_D$ to detect, after the bending process, the bend angle of the work W when the work W springs back. Specifically, once the ram 3 has reached the overstroke target value Pso, the output control section 86A controls the ram 3 to elevate and then lower again. That is, the ram 3 performs a retry operation. Upon receiving an input of a retry operation start signal from the output control section 86A, the angle detecting means 85A monitors the detected load $W_D$ to detect the detected angle θs obtained from the angle measuring instrument 9 upon a rise in the detected angle θs, as the product bend angle $\theta_2$. That is, when the upper die 4 is pressed against the work W again during the retry operation, the detected load $W_D$ occurs. A rise in the detected load $W_D$ is used to obtained a measurement timing. The purpose of using the retry operation to press the upper die again for angle detection is to improve detection accuracy by reliably pressing the corner contracting member 12 of the angle measuring instrument 9 against the work W.

The thus obtained product bend angle θs is compared with the target angle $\theta_M$ to obtain the error $\theta_D$ therebetween. The correction value generating section 83A then converts this error $\theta_D$ into the correction value Pa for the overstroke target value and outputs it. The correction value generating section 83A selects a relation curve corresponding to a pattern detected by the pattern detecting section 82A to convert the error $\theta_D$ into the correction value Pa in accordance with this relation curve.

The next correction value Pa output from the correction value generating section 83A is input to the correction section 75A, which then converts the overstroke value Pso output from the pattern detecting section 82A using the next correction value Pa. The corrected overstroke target value Pso-Pa is used to control the overstroke of the ram 3 during the next bending. The learning control is carried out in this manner.

According to the bending machine of the present invention, the angle measuring instrument for measuring the bend angle of the work is integrated into the male die and has the inductive linear position detector. Thus, the angle measuring instrument can be compactly built into a mold to accurately measure the angle during bending.

If the angle measuring instrument detects the angle based on variations in electric phase angle and has a function for offsetting and compensating for the temperature characteristic of the coil using a plurality of coils or an output from the impedance means, the angle can be more accurately measured without attenuating signals, and a simple configuration can be used to measure the angle while eliminating the effects of variations in temperature.

If the male die is formed of a plurality of split dies arranged in the die width direction and if the angle measuring instrument is housed in the housing recess formed in the side end surface of the adjacent split dies, a mold need not be split in building the angle measuring instrument therein into. Consequently, the angle measuring instrument can be easily built into the mold.

According to the method for operating a bending machine according to the present invention, the angle measuring instrument built into the upper die can be used to achieve accurate bending taking spring back into consideration. In particular, with the pattern table indicating the classification of the interrelationship between the elevated and lowered positions of the upper die, the load acting thereon, and the bend angle of the work which all occur during the bending process and the correction value conversion data for each pattern which provide the next correction value corresponding to the bend angle after spring back, appropriate corrections based on learning control can be made irrespective of the thickness of material of the work simply by providing the target value of the bend angle, thereby enabling accurate and prompt bending taking spring back into consideration.

What is claimed is:

1. A bending machine for carrying out bending, comprising:

male and female dies to sandwich a work therebetween, and an angle measuring instrument, integrated in said male die, for measuring a bend angle of the work bent by the male and female dies, said angle measuring instrument comprising:

a corner contacting member to contact with a recessed corner resulting from the bending of the work, said corner contact member having four links connected by an upper support pin, a lower support pin and two laterally spaced connection pins, a linear position coupled to the upper support pin, said linear position displaced depending on an opening angle between corner forming surfaces and an inductive-type linear position detector for measuring displacement of the linear position of the corner contacting member.

2. A bending machine according to claim 1, wherein said linear position detector detects a change in linear position based on a change in electric phase angle and uses and output from a plurality of coils or impedance means to compensate for a temperature characteristic of a coil for detecting the linear position.

3. A bending machine according to claim 1 or claim 2, the bending machine further comprising a learning control means including:

a pattern table indicating a plurality of patterns, wherein the interrelationship between an elevated and lowered positions of the upper die and a load acting on the upper die and the bend angle of the work which are measured during the bending process has been classified;

a correction value conversion data for each of said patterns which provide the next correction value for said adjustable portion corresponding to the bend angle after spring back;

a means for measuring the elevated and lowered positions of the upper die, the load acting on the upper die, and the bend angle of the work during the bending process;

a means for measuring the bend angle of the work after the work has sprung back following retreating of the upper die or releasing of pressurization on the upper die; and a correction value generating means for selecting the corresponding pattern from said pattern table based on values of the elevated and lowered positions of the upper die, the load acting on the upper die, the bend angle of the work which have all been obtained during the bending process, and using the selected pattern to generate the next correction value for the adjustable portion corresponding to the bend angle after spring back, in accordance with said correction value conversion data.

4. A bending machine for carrying out bending comprising:

male and female dies to sandwich a work therebetween, and an angle measuring instrument, integrated in said male die, for measuring a bend angle of the work bent by the male and female dies, said angle measuring instrument comprising:

a corner contacting member to contact with a recessed corner resulting from the bending of the work, said corner contact member having a linear position displaced depending on an opening angle between corner forming surfaces and an inductive-type linear position detector for measuring displacement of the linear position of the corner contacting member wherein said male die comprises a plurality of split dies arranged in die width direction so that the die width can be changed by changing the number of arranged split dies and any ones of the split dies have an housing recess in side end surfaces thereof in which said angle measuring instrument is housed.

5. A method for operating a bending machine, the method comprising the steps of:

measuring, during a bending process, an elevated and lowered positions of an upper die corresponding to the male die, a load acting on the upper die, and the bend angle of the work, measuring, after the bending process, the bend angle of the work after spring back after retreating the upper die or releasing pressurization on the upper die, and obtaining a next correction value for an adjustable portion for controlling the bend angle for the bending machine, based on an interrelationship among the measured elevated and lowered positions of the upper die, the measured load acting on the upper die, the measured bend angle of the work, and the measured bend angle after spring back.

6. A method for operating a bending machine according to claim 5, wherein a lower die corresponding to the male die has a variable bottom surface height such that said bending machine carries out bending by lowering the upper die until the work has been pressed against a bottom surface of the lower die, said adjustable portion is located at the bottom surface height of the lower die, and the next correction value obtained from said correction value conversion data is a correction value for said bottom surface height.

7. A method for operating a bending machine according to claim 5, wherein said bending machine determines the bend angle by adjusting an amount that the upper die corresponding to the male die advances into the lower die, and the next correction value obtained from said correction value conversion data is a correction value for a target value for overstroke in which the upper die is lowered further from the elevated or lowered position of the upper die which corresponds to a target angle for the work bend angle.

8. A method for operating a bending machine, the method comprising the steps of:

preparing a pattern table indicating a plurality of patterns into which the interrelationship between the elevated and lowered positions of the upper die and the load acting on the upper die and the bend angle of the work which are measured during the bending process has been classified, and correction value conversion data for each of said patterns to provide the next correction value for said adjustable portion corresponding to the bend angle after spring back, comparing said pattern table with the elevated and lowered positions of the upper die and the load acting on the upper die and the bend angle of the work which have been measured during the bending process, to select a corresponding pattern, and using the correction conversion data for the selected pattern to convert said bend angle after spring back measuring after the bending process in order to obtain the next correction value for the adjustable portion.

9. A method for opening a bending machine according to claim 8, wherein the pattern of the relationship between the elevated and lowered positions of the upper die and the load acting on the upper die and the bend angle of the work which all occur during the bending process is classified in such a manner as to correspond to a stroke of the upper die from a load dip to a target angle and a stroke thereof from the target angle to the lowest point.

* * * * *